US008699908B2

(12) United States Patent
Kikuchi et al.

(10) Patent No.: US 8,699,908 B2
(45) Date of Patent: Apr. 15, 2014

(54) CLEANING DEVICE AND IMAGE FORMING APPARATUS INCLUDING SAME

(75) Inventors: Hisashi Kikuchi, Kanagawa (JP); Takaya Muraishi, Kanagawa (JP); Kenji Sugiura, Kanagawa (JP); Akira Asaoka, Kanagawa (JP); Yoshiki Hozumi, Kanagawa (JP); Yuu Sakakibara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 217 days.

(21) Appl. No.: 13/271,636

(22) Filed: Oct. 12, 2011

(65) Prior Publication Data

US 2012/0099883 A1 Apr. 26, 2012

(30) Foreign Application Priority Data

Oct. 22, 2010 (JP) ..... 2010-237825

(51) Int. Cl.
*G03G 15/00* (2006.01)

(52) U.S. Cl.
USPC ..... 399/71; 399/101; 399/353

(58) Field of Classification Search
USPC ..... 399/71, 101, 354
See application file for complete search history.

(56) References Cited

U.S. PATENT DOCUMENTS

| | | | | |
|---|---|---|---|---|
| 5,546,177 | A * | 8/1996 | Thayer | 399/353 |
| 5,652,945 | A * | 7/1997 | Thayer et al. | 399/34 |
| 6,377,761 | B1 * | 4/2002 | Nichols | 399/34 |
| 2007/0230994 | A1 * | 10/2007 | Takishita | 399/101 |
| 2011/0103822 | A1 | 5/2011 | Sugiura et al. | |
| 2011/0158677 | A1 | 6/2011 | Kikuchi et al. | |
| 2011/0229187 | A1 | 9/2011 | Hozumi et al. | |
| 2011/0229234 | A1 * | 9/2011 | Hozumi et al. | 399/357 |
| 2012/0008973 | A1 * | 1/2012 | Sakakibara et al. | 399/71 |

FOREIGN PATENT DOCUMENTS

| | | |
|---|---|---|
| JP | 1-292116 | 11/1989 |
| JP | 3-64604 | 10/1991 |
| JP | 7-33606 | 4/1995 |
| JP | 7-33637 | 4/1995 |
| JP | 10-131035 | 5/1998 |
| JP | 10-310974 | 11/1998 |
| JP | 2006-58422 | 3/2006 |
| JP | 2007-25173 | 2/2007 |
| JP | 2009-25471 | 2/2009 |

* cited by examiner

*Primary Examiner* — David Gray
*Assistant Examiner* — Francis Gray
(74) *Attorney, Agent, or Firm* — Oblon, Spivak, McClelland, Maier & Neustadt, L.L.P.

(57) ABSTRACT

A cleaning device including a rotatable cleaning member contacting a rotatable image carrier bearing a toner image to electrostatically remove toner from the image carrier while rotating, and a control unit to control rotation of the cleaning member to satisfy a relation of (60/R)>(L/V) during removal of a toner pattern formed on the image carrier at a predetermined timing and remaining attached to the image carrier without being transferred from the image carrier onto a transfer member using the cleaning member, where R (rpm) is a number of rotations of the cleaning member, L (mm) is a length of the toner pattern in a direction of rotation of the image carrier, and V (mm/s) is a speed of the image carrier.

5 Claims, 7 Drawing Sheets

CLEANING DEVICE AND IMAGE FORMING APPARATUS INCLUDING SAME

CROSS-REFERENCE TO RELATED APPLICATIONS

The present patent application is based on and claims priority pursuant to 35 U.S.C. §119 from Japanese Patent Application No. 2010-237825, filed on Oct. 22, 2010, in the Japan Patent Office, which is incorporated by reference herein in its entirely.

BACKGROUND OF THE INVENTION

1. Field of The Invention

Exemplary aspects of the present invention generally relate to a cleaning device and an image forming apparatus including the cleaning device.

2. Description of the Background

Related-art image forming apparatuses, such as copiers, printers, facsimile machines, and multifunction devices having two or more of copying, printing, and facsimile functions, typically form a toner image on a transfer member (e.g., a sheet of paper, etc.) according to image data using an electrophotographic method. In such a method, for example, a charger charges a surface of a photoconductor; an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of transfer members; and a fixing device applies heat and pressure to the sheet bearing the toner image to fix the toner image onto the sheet. The sheet bearing the fixed toner image is then discharged from the image forming apparatus.

There is known an image forming apparatus including a cleaning device that electrostatically removes untransferred residual toner from an image carrier after transfer of a toner image from the image carrier onto a sheet. Specifically, the cleaning device includes a cleaning brush roller serving as a cleaning member that rotatably contacts the image carrier, a collection roller serving as a collection member that rotatably contacts the cleaning brush roller, and a scraping blade that contacts the collection roller. A cleaning voltage having a polarity opposite a normal charging polarity of toner is supplied to the cleaning brush roller. In addition, a collection voltage having the same polarity as and greater than the cleaning voltage is supplied to the collection roller. Untransferred toner remaining attached to the image carrier without being transferred onto the sheet is electrostatically moved from the image carrier to the cleaning brush roller by an electric field formed between the image carrier and the cleaning brush roller while being scraped off from the image carrier by the rotatable cleaning brush roller. The toner thus moved to the cleaning brush roller is further electrostatically moved to the collection roller, and then scraped off from the collection roller by the scraping blade.

In addition to the toner image, the image forming apparatus also forms a toner pattern for quality control at a predetermined timing. The toner pattern thus formed on the image carrier is detected by an optical sensor or the like. Image density of the formed toner pattern is then adjusted and color shift is corrected based on the detected result to achieve higher image quality. The toner pattern is also formed at an interval between sheets on the image carrier to replenish the developing device with new toner to achieve higher quality image. Subsequently, the above-described toner pattern formed on the image carrier for the purpose of providing higher quality image is simply removed from the image carrier by the cleaning device without being transferred onto the sheet.

However, although the toner patterns are reliably removed from the image carrier by the cleaning brush roller immediately after the toner patterns enter a contact position between the image carrier and the cleaning brush roller, the related-art cleaning device cannot reliably remove the toner patterns after a certain period of time elapses, causing irregular cleaning.

SUMMARY

In view of the foregoing, illustrative embodiments of the present invention provide a novel cleaning device that can provide better cleaning performance to reliably remove a toner pattern from an image carrier, and an image forming apparatus including the cleaning device.

In one illustrative embodiment, a cleaning device includes a rotatable cleaning member contacting a rotatable image carrier bearing a toner image to electrostatically remove toner from the image carrier while rotating and a control unit. The control unit controls rotation of the cleaning member to satisfy a relation of $(60/R)>(L/V)$ during removal of a toner pattern formed on the image carrier at a predetermined timing and remaining attached to the image carrier without being transferred from the image carrier onto a transfer member using the cleaning member, where R (rpm) is a number of rotations of the cleaning member, L (mm) is a length of the toner pattern in a direction of rotation of the image carrier, and V (mm/s) is a speed of the image carrier.

Another illustrative embodiment provides a cleaning device including multiple cleaning members arranged consecutively in a direction of rotation of an image carrier and contacting the image carrier bearing a toner image to electrostatically remove toner from the image carrier while rotating and a control unit. The control unit controls rotation of a cleaning member among the multiple cleaning members provided on an upstream side in the direction of rotation of the image carrier to satisfy a relation of $(60/R)>(L/V)$ during removal of a toner pattern formed on the image carrier at a predetermined timing and remaining attached to the image carrier without being transferred from the image carrier onto a transfer member using the multiple cleaning members, where R (rpm) is a number of rotations of the cleaning member provided on the extreme upstream side in the direction of rotation of the image carrier, L (mm) is a length of the toner pattern in the direction of rotation of the image carrier, and V (mm/s) is a speed of the image carrier.

Yet another illustrative embodiment provides an image forming apparatus including a rotatable image carrier, an image forming unit to form a toner image on the image carrier, a cleaning device including a rotatable cleaning member to electrostatically remove toner from the image carrier while rotating, and a control unit. The control unit controls at least one of the image forming unit, a speed of the image carrier, and rotation of the cleaning member to satisfy a relation of $(60/R)>(L/V)$ during removal of a toner pattern formed on the image carrier at a predetermined timing and remaining attached to the image carrier without being transferred from the image carrier onto a transfer member using the cleaning member, where R (rpm) is a number of rotations of the cleaning member, L (mm) is a length of the toner pattern in a direction of rotation of the image carrier, and V (mm/s) is a speed of the image carrier.

Additional features and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
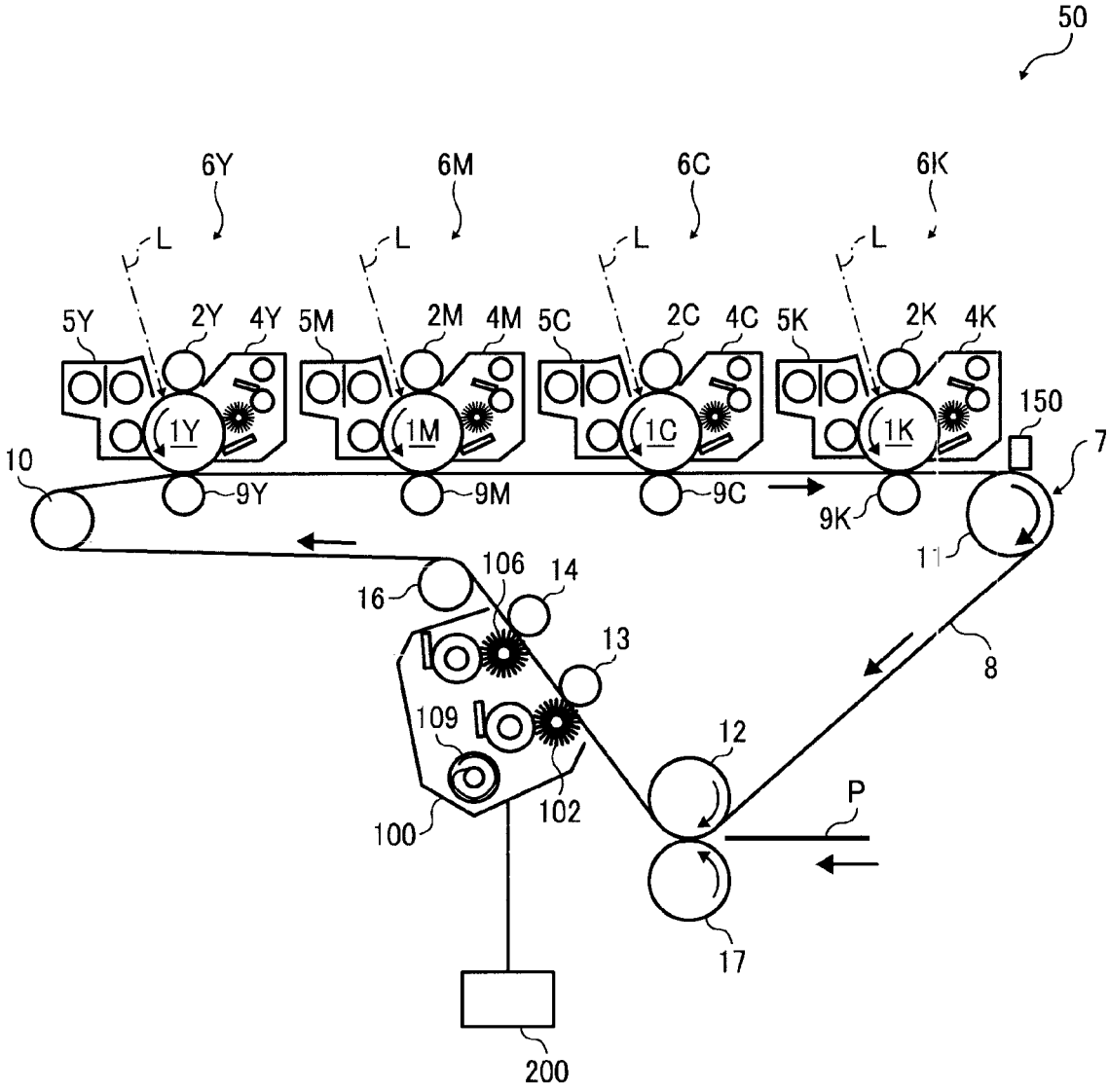
FIG. 1 is a vertical cross-sectional view illustrating an example of a configuration of a main part of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A basic configuration and operation of a tandem-type printer employing an intermediate transfer system that serves as an image forming apparatus 50 according to illustrative embodiments are described in detail below.

FIG. 1 is a vertical cross-sectional view illustrating an example of a configuration of a main part of the image forming apparatus 50. The image forming apparatus 50 includes four process units 6Y, 6M, 6C, and 6K (hereinafter collectively referred to as process units 6) that form a toner image of a specific color, that is, yellow (Y), magenta (M), cyan (C), or black (K). The process units 6 includes drum-shaped photoconductors 1Y, 1M, 1C, and 1K (hereinafter collectively referred to as photoconductors 1), respectively. Chargers 2Y, 2M, 2C, and 2K (hereinafter collectively referred to as chargers 2), developing devices 5Y, 5M, 5C, and 5K (hereinafter collectively referred to as developing devices 5), drum cleaning devices 4Y, 4M, 4E, and 4K (hereinafter collectively referred to as drum cleaning devices 4), neutralizing devices, not shown, and so forth are provided around the photoconductors 1, respectively. Each of the four process units 6 has the same basic configuration, differing only in the color of toner used. An optical unit, not shown, that directs laser light L onto surfaces of the photoconductors 1 to form electrostatic latent images on the surfaces of the photoconductors 1 is provided above the process units 6.

A transfer unit 7 including an endless intermediate transfer belt 8 serving as an image carrier is provided below the process units 6. The image forming apparatus 50 further includes multiple extension rollers provided inside a loop of the intermediate transfer belt 8 and components provided outside the loop of the intermediate transfer belt 8, such as a secondary transfer roller 17, a pressing roller 16, and a belt cleaning device 100.

Four primary transfer rollers 9Y, 9M, 9C, and 9K (hereinafter collectively referred to as primary transfer rollers 9), a tension roller 10, a drive roller 11, a secondary transfer opposing roller 12, and first and second opposing rollers 13 and 14 are provided inside the loop of the intermediate transfer belt 8. At least the four primary transfer rollers 9, the tension roller 10, the drive roller 11, and the secondary transfer opposing roller 12 function as the extension rollers around which the intermediate transfer belt 8 is wound. The intermediate transfer belt 8 is rotated in a clockwise direction in FIG. 1 by rotation of the drive roller 11 rotatively driven in the clockwise direction by drive means, not shown.

The primary transfer rollers 9 are provided opposite the photoconductors 1, respectively, with the intermediate transfer belt 8 interposed therebetween. Accordingly, primary transfer nips are formed at portions where the intermediate transfer belt 8 contacts each of the photoconductors 1. A primary transfer bias having a polarity opposite a polarity of toner is supplied from a power source, not shown, to each of the primary transfer rollers 9.

The secondary transfer opposing roller 12 is provided opposite the secondary transfer roller 17 with the intermediate transfer belt 8 interposed therebetween. Accordingly, a secondary transfer nip is formed at a portion where the intermediate transfer belt 8 contacts the secondary transfer roller 17. It is to be noted that a secondary transfer bias having a polarity opposite the polarity of toner is supplied from a power source, not shown, to the secondary transfer roller 17. Alternatively, a conveyance belt that conveys a transfer member such as a sheet of paper may be wound around the secondary transfer roller 17, multiple support rollers, and a drive roller. In such a case, the secondary transfer roller 17 is provided opposite the secondary transfer opposing roller 12 with both the intermediate transfer belt 8 and the conveyance belt interposed therebetween.

The first and second opposing rollers 13 and 14 are provided opposite first and second cleaning brush rollers 102 and 106 of the belt cleaning device 100, respectively, with the intermediate transfer belt 8 interposed therebetween. Accordingly, cleaning nips are formed at portions where the intermediate transfer belt 8 contacts each of the first and second cleaning brush rollers 102 and 106. It is to be noted that the first and second opposing rollers 13 and 14 may be rotatively driven by drive means, not shown, or may be driven by the rotation of the intermediate transfer belt 8. The belt cleaning device 100 and the intermediate transfer belt 8 are integrally replaceable with a new component. Alternatively, the belt cleaning device 100 and the intermediate transfer belt 8 may be attached to and detached from the image forming apparatus 50 separately from each other in a case in which each of the belt cleaning device 100 and the intermediate transfer belt 8 has the different product life.

The image forming apparatus 50 further includes a sheet feeder, not shown. The sheet feeder includes a sheet feed cassette that stores a sheet P and a sheet feed roller that feeds the sheet P from the sheet feed cassette to a sheet feed path in the image forming apparatus 50. A pair of registration rollers, not shown, is provided upstream of the secondary transfer nip in a direction of sheet feed to temporarily stop conveyance of the sheet P fed from the sheet feeder and to convey the sheet P to the secondary transfer nip at a predetermined timing. The sheet P is further conveyed from the secondary transfer nip to a fixing device, not shown, provided downstream of the secondary transfer nip to fix a toner image onto the sheet P. The image forming apparatus 50 further includes toner supplier that supplies toner to the developing devices 5 as needed.

In addition to the plain paper that is widely used as the sheet P, special paper such as paper having an uneven surface and iron-on print paper used for thermal transfer is often used in recent years. Use of such special paper more often causes irregular secondary transfer of the toner image from the intermediate transfer belt 8 compared to use of the plain paper. Therefore, in the image forming apparatus 50, the intermediate transfer belt 8 is provided with a certain elasticity to be deformable at the secondary transfer nip in conformity with the toner image or the uneven surface of the sheet P. As a result, the intermediate transfer belt 8 can fully contact the uneven surface of the sheet P without an excessive transfer pressure at the secondary transfer nip, thereby preventing irregular transfer of the toner image. Thus, the toner image is evenly transferred onto the uneven surface of the sheet P, thereby providing a higher-quality image having even image density.

Specifically, the intermediate transfer belt 8 is constructed of at least a base layer, an elastic layer on the base layer, and a surface coating layer provided on the elastic layer.

The elastic layer of the intermediate transfer belt 8 is formed of an elastic material. Specific examples of the elastic material include, but are not limited to, elastic rubber, elastomer, butyl rubber, fluororubber, acrylic rubber, EPDM, NBR, acrylonitrile-butadiene-styrene rubber, natural rubber, isoprene rubber, styrene-butadiene rubber, butadiene rubber, urethane rubber, syndiotactic 1,2-polybutadiene, epichlorohydrine rubber, polysulfide rubber, polynorbornene rubber, and thermoplastic elastomer (e.g., polystyrene resin, polyolefin resin, polyvinyl chloride resin, polyurethane resin, polyamide resin, polyurea resin, polyester resin, or fluorocarbon resin). These materials can be used alone or in combination.

Although depending on the hardness and the structure of the intermediate transfer belt 8, a thickness of the elastic layer is preferably from 0.07 mm to 0.5 mm, and more preferably from 0.25 mm to 0.5 mm. When the intermediate transfer belt 8 is thinner than 0.07 mm, the pressure against the toner on the intermediate transfer belt 8 at the secondary transfer nip is increased and transfer defects tend to occur, thereby degrading transfer efficiency of the toner.

It is preferable that the elastic layer have a JIS-A hardness of from 10° to 65°. Although the optimal hardness of the elastic layer depends on the thickness of the intermediate transfer belt 8, a hardness lower than the JIS-A hardness of 10° tends to cause transfer defects. By contrast, a hardness higher than the JIS-A hardness of 65° makes the intermediate transfer belt 8 difficult to be wound around the rollers. Further, the intermediate transfer belt 8 is stretched over time, thereby degrading durability and causing frequent replacement.

The base layer of the intermediate transfer belt 8 is formed of resin with less stretch. Specific examples of the materials used for the base layer include, but are not limited to, one or more of polycarbonate, fluorocarbon resin (e.g. ETFE or PVDF), polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylate copolymer (e.g. styrene-methyl acrylate copolymer, styrene-ethyl acrylate copolymer, styrene-butyl acrylate copolymer, styrene-octyle acrylate copolymer or styrene-phenyl acrylate copolymer), styrene-methacrylate copolymer (e.g. styrene-methyl methacrylate copolymer, styrene-ethyl methacrylate copolymer or styrene-phenyl methacrylate copolymer), styrene-α-methyl chloroacrylate copolymer, styrene-acrylonitrile-acrylate copolymer or similar styrene resin (e.g. polymer or copolymer containing styrene or substituted styrene), methyl methacrylate resin, butyl methacrylate resin, ethyl acrylate resin, butyl acrylate resin, modified acrylic resin (silicone modified acrylic resin, vinyl chloride resin modulated acrylic resin or acryl-urethane resin), vinyl chloride resin, styrene-vinyl acetate resin copolymer, vinyl chloride-vinyl acetate copolymer, rosin modulated maleic ester resin, phenol resin, epoxy resin, polyester resin, polyester-polyurethane resin, polyethylene, polypropylene, polybutadiene, polyvinylidene chloride, ionomer resin, polyurethane resin, silicone resin, ketone resin, ethylene-ethyl acrylate copolymer, xylene resin, polyvinyl butyral resin, polyamide resin, and modified polyphenylene oxide resin.

It is to be note that, in order to prevent stretching of the elastic layer formed of the rubber material with a larger stretch, a core layer formed of a material such as a canvas may be provided between the base layer and the elastic layer of the intermediate transfer belt 8. Specific examples of the material used for the core layer include, but are not limited to, natural fibers such as cotton and silk, synthetic fibers such as polyester fibers, nylon fibers, acrylic fibers, polyorefine fibers, polyvinyl alcohol fibers, polyvinyl chloride fibers, polyvinylidene chloride fibers, polyurethane fibers, polyacetal fibers, polyfluoroethylene fibers, and phenol fibers, inorganic fibers such as carbon fibers and glass fibers, metal fibers such as iron fibers and copper fibers, and combinations of two or more of the above-described materials. The fibers may be configured as threads or textile and may be twisted in any suitable manner. Of course, the threads may be processed to have electric conduction. The textile may be woven in any suitable manner such as tockinette, and may be provided with conductivity.

The surface of the elastic layer of the intermediate transfer belt 8 is coated with the surface coating layer having smoothness. Although not particularly limited to, materials that reduce adhesion of the toner to the surface of the intermediate transfer belt 8 to improve the secondary transfer efficiency is generally used for the surface coating layer. Specific examples of materials used for the surface coating layer include, but are not limited to, polyurethane resin, polyester resin, epoxy resin, and combinations of two or more of the above-described materials. Alternatively, a material that reduces surface energy to improve lubricating property, such as fluorocarbon resin grains, fluorine compound grains, carbon fluoride grains, titanium oxide grains, and silicon carbide grains with or without the grain size being varied may be used alone or in combination. Further, fluororubber may be heated to form a fluorine layer on the surface thereof, thereby reducing surface energy.

In order to adjust resistance, each of the base layer, the elastic layer, and the surface coating layer may be formed of metal powder such as carbon black, graphite, aluminum, and nickel, conductive metal oxides such as tin oxide, titanium oxide, antimony oxide, indium oxide, potassium titanate, ATO (antimony oxide-tin oxide), ITO (indium oxide-tin oxide), or the like. The conductive metal oxide may be coated with insulative fine grains such as, but are not limited to, barium sulfate, magnesium silicate, or calcium carbonate.

Upon receipt of image data, the image forming apparatus 50 rotatively drives the drive roller 11 to rotate the intermediate transfer belt 8. The extension rollers other than the drive roller 11 are driven by the rotation of the intermediate transfer belt 8 itself. At the same time, the photoconductors 1 are rotatively driven. The chargers 2 evenly charge the surfaces of the photoconductors 1, and the laser light L is directed onto the charged surfaces of the photoconductors 1 to form electrostatic latent images on the surfaces of the photoconductors 1, respectively. The electrostatic latent images thus formed on the surfaces of the photoconductors 1 are developed by the developing devices 5 so that toner images of the respective colors are formed on the surfaces of the photoconductors 1. The toner images of the respective colors are primarily transferred from the surfaces of the photoconductors 1 onto the intermediate transfer belt 8 at the primary transfer nips, respectively, and sequentially superimposed one atop the other to form a full-color toner image on the intermediate transfer belt 8. Thus, an image forming unit that forms the toner image on the intermediate transfer belt 8 is constructed of the process units 6, the optical writing unit, and the primary transfer rollers 9. In addition, an image forming unit that forms the toner images on the photoconductors 1, each of which also serves as an image carrier, is constructed of the chargers 2, the optical writing unit, and the developing devices 5.

Meanwhile, in the sheet feeder, not shown, the sheets P are fed one by one from the sheet feed cassette by the sheet feed roller to be conveyed to the pair of registration rollers. The pair of registration rollers is driven such that the sheet P is conveyed to the secondary transfer nip in synchronization with the full-color toner image formed on the intermediate transfer belt 8. Accordingly, the full-color toner image is secondarily transferred from the intermediate transfer belt 8 onto the sheet P. Thus, the full-color toner image is formed on the sheet P. The sheet P bearing the full-color toner image thereon is then conveyed from the secondary transfer nip to the fixing device to fix the full-color toner image onto the sheet P.

The drum cleaning devices 4 remove residual toner from the surfaces of the photoconductors 1, respectively, after primary transfer of the toner images from the surfaces of the photoconductors 1 onto the intermediate transfer belt 8. Thereafter, the neutralizing devices neutralize the surfaces of the photoconductors 1, and then the chargers 2 evenly charge the surfaces of the photoconductors 1 to be ready for the next sequence of image formation. The belt cleaning device 100 removes from the intermediate transfer belt 8 untransferred toner, which is not transferred onto the sheet P and still remains on the intermediate transfer belt 8, after secondary transfer of the full-color toner image from the intermediate transfer belt 8 onto the sheet P.

Figure 2:
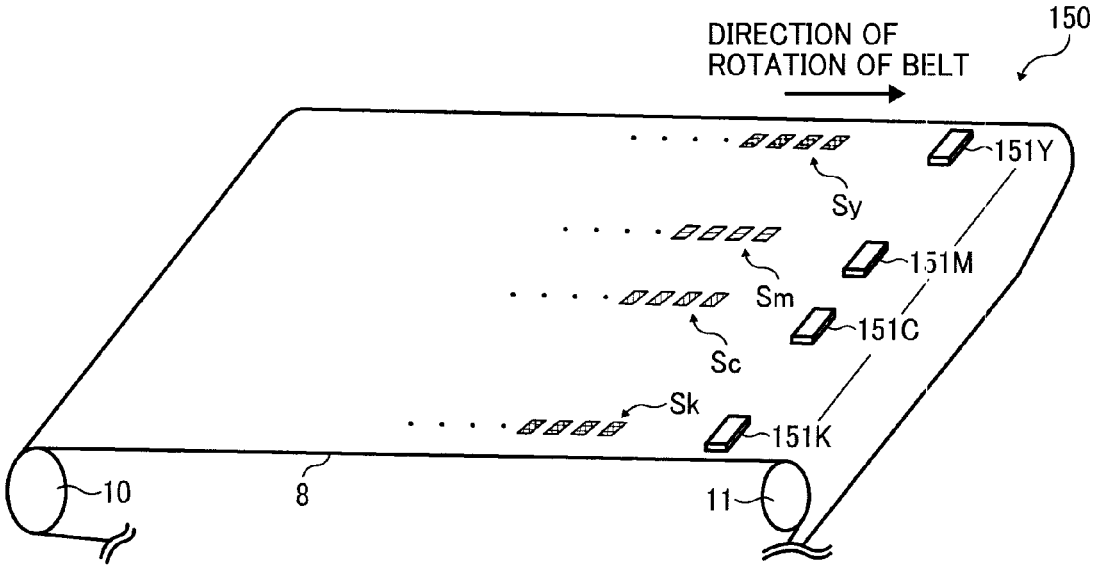
FIG. 2 is an enlarged schematic view illustrating gradation patterns formed on an intermediate transfer belt and optical sensors provided near the intermediate transfer belt.

On a downstream side from the process unit 6K in a direction of rotation of the intermediate transfer belt 8, an optical sensor unit 150 is provided opposite the intermediate transfer belt 8 with a predetermined interval interposed therebetween. As illustrated in FIG. 2, the optical sensor unit 150 includes optical sensors 151Y, 151M, 151C, and 151K (hereinafter collectively referred to as optical sensors 151) arranged side by side in a width direction of the intermediate transfer belt 8. Each of the optical sensors 151 includes a reflective-type photosensor in which light emitted from a light emitter is reflected from the intermediate transfer belt 8 or the toner image on the intermediate transfer belt 8 and a light receiver detects an amount of the reflected light. A control unit 200 detects presence and an image density of the toner image on the intermediate transfer belt 8 based on an amount of voltage output from the optical sensors 151.

In order to adjust the image density of each color, the image density is controlled each time the image forming apparatus 50 is turned on or images are formed on predetermined number of the sheets P.

During image density control, first, graduation patterns Sy, Sm, Sc, and Sk (hereinafter collectively referred to as graduation patterns S) are automatically formed on the intermediate transfer belt 8 at positions opposite the optical sensors 151, respectively, as illustrated in FIG. 2. Each of the graduation patterns S is constructed of ten toner patches, each having a size of 2 cm×2 cm with a different image density. Unlike during image formation in which the surfaces of the photoconductors 1 are evenly charged by the chargers 2, a charging electric potential of each of the surfaces of the photoconductors 1 is gradually increased during formation of the graduation patterns S. Then, laser light L is directed onto the surfaces of the photoconductors 1 to form electrostatic latent images for the multiple toner patches of the graduation patterns S on the surfaces of the photoconductors 1. The electrostatic latent images thus formed are then developed by the developing devices 5. During development, an amount of a developing bias supplied to each of developing rollers respectively included in the developing devices 5 is gradually increased. As a result, the graduation patterns S of the respective colors are formed on the surfaces of the photoconductors 1. The graduation patterns S are primarily transferred onto the intermediate transfer belt 8 so that the multiple toner patches of each of the graduation patterns S are arranged side by side at equal intervals in a main scanning direction of the intermediate transfer belt 8. At this time, an amount of toner attached to each of the toner patches is about from 0.1 $mg/cm^2$ to 0.55 $mg/cm^2$, and a charge amount (Q/d) distribution of the toner is substantially a normal charging polarity.

The graduation patterns S formed on the intermediate transfer belt 8 pass through the optical sensors 151 as the intermediate transfer belt 8 rotates. At this time, each of the optical sensors 151 receives an amount of light corresponding to an amount of toner attached to a unit area in each of the toner patches of the graduation patterns S.

Next, the amount of toner attached to each of the toner patches of the graduation patterns S is calculated based on an amount of voltage output from each of the optical sensors 151 upon detection of the toner patches and a transformation algorithm to adjust image formation conditions based on the amount of toner thus calculated. Specifically, a linear function of y=ax+b is calculated by regression analysis based on the amount of toner attached to each of the toner patches detected by the optical sensors 151 and a developing potential during formation of the toner patches. Then, a target image density is assigned to the linear function to calculate an appropriate developing bias and specify the developing bias for each toner color.

Memory stores a data table for image forming conditions in which several dozen combinations of developing biases and corresponding charging potentials are associated with each other. A developing bias that is the closest to the specified developing bias is selected from the data table for each of the process units 6, and the charging potential associated with the selected developing bias is specified.

Figure 3:
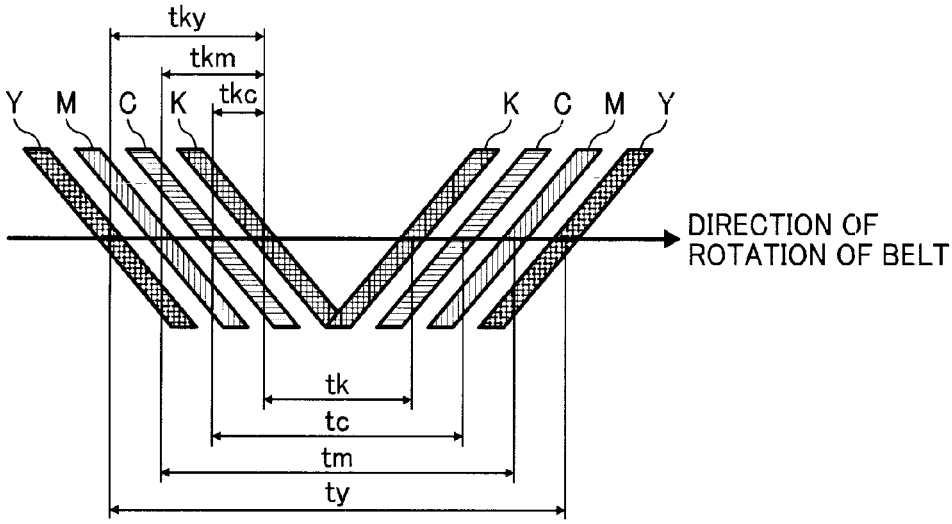
FIG. 3 is an enlarged schematic view illustrating a chevron patch formed on the intermediate transfer belt.

In addition, an amount of color shift is corrected each time the image forming apparatus 50 is turned on or images are formed on predetermined number of the sheets P. In order to correct an amount of color shift, an image for detecting color shift called a chevron patch constructed of toner images of yellow (Y), magenta (M), cyan (C), and black (K) as illustrated in FIG. 3 is formed at both edges of the intermediate transfer belt 8 in the width direction thereof. The chevron patch is a group of line patterns in which the toner images of the respective colors tilted at about 45° from the main scanning direction of the intermediate transfer belt 8 are arranged side by side at predetermined pitches in a sub-scanning direction, that is, the direction of rotation of the intermediate transfer belt 8. An amount of toner attached to the chevron patch is about 0.3 mg/cm$^2$.

The toner images of the respective colors in the chevron patch formed at both edges of the intermediate transfer belt 8 are detected to obtain a position of each of the toner images in both the main scanning direction (or an axial direction of the photoconductors 1) and the sub-scanning direction, a magnification error in the main scanning direction, and a skew from the main scanning direction. Here, the main scanning direction corresponds to a direction in which the laser light L reflected from the polygon mirror scans on the surfaces of the photoconductors 1. A difference in detection timings between the black toner image in the chevron patch and each of the yellow, magenta, and cyan toner images in the chevron patch is read by the optical sensors 151. The vertical direction in the surface of the sheet of paper on which FIG. 3 is drawn corresponds to the main scanning direction. Starting from the left in FIG. 3, the yellow, magenta, cyan, and black toner images are arranged side by side, in that order, and then the black, cyan, magenta, and yellow toner images each tiled at 90° from the former toner images, respectively, are further arranged side by side, in that order. Based on differences between actual measured values and theoretical values in differences in detection timings tky, tkm, and tkc from the black toner image (a reference color), an amount of positional shift in each of the toner images in the sub-scanning direction, that is, an amount of registration shift, is obtained. Then, based on the amount of registration shift thus obtained, a timing to start optical writing to the photoconductors 1 is corrected for every other surface of a polygon mirror to reduce the amount of registration shift in each of the toner images. In addition, an inclination (or a skew) of each of the toner images from the main scanning direction is obtained based on the difference in the positional shift between the edges of the intermediate transfer belt 8 in the sub-scanning direction. Based on the result thus obtained, optical face tangle error in a reflective mirror is corrected to reduce a skew shift in each of the toner images. Thus, the timing to start optical writing and the optical face tangle error are corrected based on the timings for detecting the toner images in the chevron patch, and the registration shift and the skew shift are reduced to correct the color shift. Accordingly, a color shift in the resultant image caused by a shift in formation positions of the toner images on the intermediate transfer belt 8 over time due to temperature changes or the like can be prevented.

When images having less image area are continuously formed, an amount of old toner stored in the developing devices 5 over time is increased. Consequently, charging property of the toner deteriorates, thereby degrading image quality. In order to prevent accumulation of such old toner in the developing devices 5, a refresh mode is activated such that the old toner is discharged to a non-imaging range onto each of the surfaces of the photoconductors 1 at a predetermined timing to supply fresh toner to the developing devices 5.

An amount of toner consumed and an operating time for each of the developing devices 5 are stored in the control unit 200. The control unit 200 checks whether or not the amount of consumed toner is smaller than a threshold at a predetermined timing for each operating time of the developing devices 5 during a predetermined period of time. When the amount of consumed toner is less than the threshold, the refresh mode is activated for the corresponding developing device 5.

Figure 4:
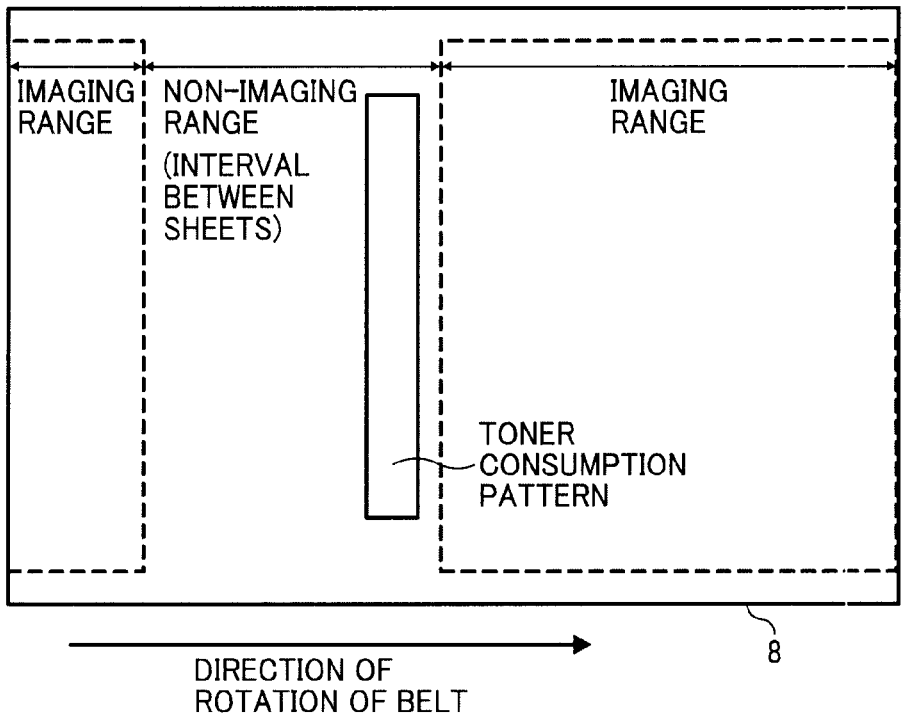
FIG. 4 is an enlarged schematic view illustrating a toner consumption pattern formed on the intermediate transfer belt.

During the refresh mode, a toner consumption pattern is formed at the non-imaging range on the surfaces of the photoconductors 1, which corresponds to an interval between each of the sheets P. The toner consumption pattern thus formed is then transferred onto the intermediate transfer belt 8 as illustrated in FIG. 4. An amount of toner attached to the toner consumption pattern is determined based on an amount of toner consumed in the operating time of the developing devices 5 during a predetermined period of time, and the maximum amount of toner attached to a unit area may be about 1.0 mg/cm$^2$. A charge amount (Q/d) distribution of the toner in the toner consumption pattern transferred onto the intermediate transfer belt 8 is substantially a normal charging polarity.

A description is now given of a configuration of the belt cleaning device 100 included in the image forming apparatus 50.

Figure 5:
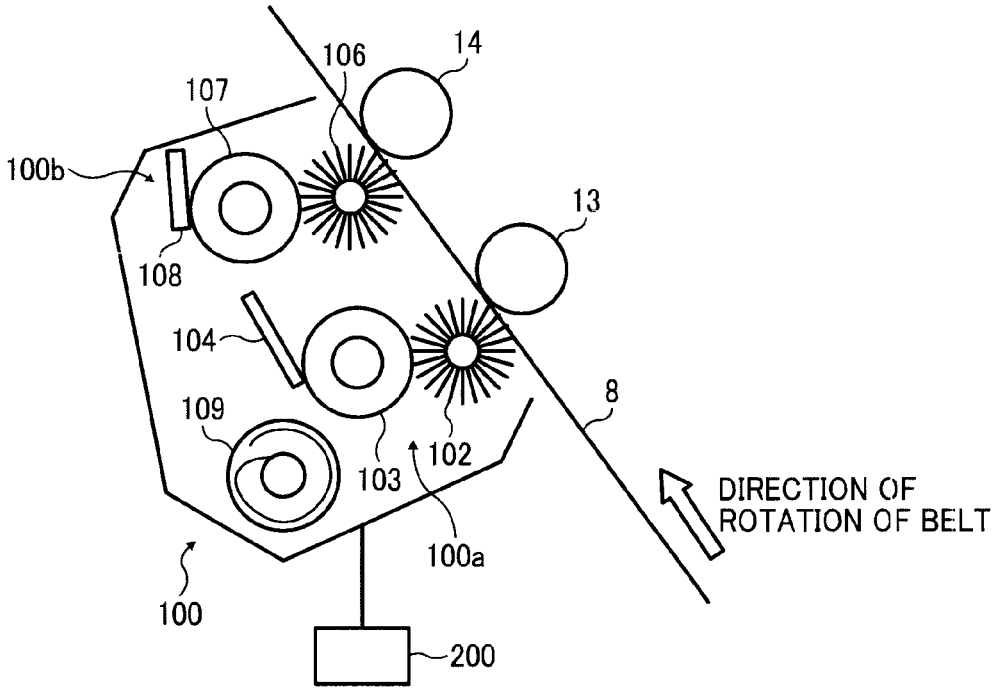
FIG. 5 is a schematic view illustrating an example of a configuration of a belt cleaning device and surrounding components according to a first illustrative embodiment.

FIG. 5 is a schematic view illustrating an example of a configuration of the belt cleaning device 100 and surrounding components according to a first illustrative embodiment. The belt cleaning device 100 includes a first cleaning part 100*a* that removes negatively charged toner having a normal charging polarity of the toner from the intermediate transfer belt 8 and a second cleaning part 100*b* that removes positively charged toner having a polarity opposite the normal charging polarity of toner from the intermediate transfer belt 8.

The first cleaning part 100*a* includes the first cleaning brush roller 102 serving as a first cleaning member, a first collection roller 103 that collects toner attached to the first cleaning brush roller 102, and a first scraper 104 that contacts the first collection roller 103 to scrape off the toner from a surface of the first collection roller 103.

The first cleaning brush roller 102 is constructed of a rotatably supported metal rotary shaft and a brush part formed of multiple bristles provided to a circumference of the metal rotary shaft. A positive first cleaning bias having a polarity opposite the normal charging polarity of toner is supplied to the first cleaning brush roller 102 from a power source, not shown. A first collection bias having a positive polarity and greater than the first cleaning bias is supplied to the first collection roller 103 from a power source, not shown.

The second cleaning part 100*b* is provided downstream from the first cleaning part 100*a* in the direction of rotation of the intermediate transfer belt 8, and includes the second cleaning brush roller 106 serving as a second cleaning member, a second collection roller 107, and a second scraper 108, arranged in a similar manner as the first cleaning part 100*a*. The second cleaning brush roller 106 is constructed of a rotatably supported metal rotary shaft and a brush part formed of multiple conductive bristles provided to a circumference of the metal rotary shaft. A negative second cleaning bias having the same polarity as the normal charging polarity of toner is supplied to the second cleaning brush roller 106 from a power source, not shown. A second collection bias having the negative polarity and greater than the second cleaning bias is supplied to the second collection roller 107 from a power source, not shown.

The toner removed from the intermediate transfer belt 8 by the first and second cleaning parts 100*a* and 100*b* and collected at one end of the casing of the belt cleaning device 100 is discharged from the belt cleaning device 100 through a discharge screw 109. The toner thus discharged from the belt cleaning device 100 through the discharge screw 109 falls into a waste toner tank, not shown, provided to the image forming apparatus 50. Alternatively, the toner may be returned to the corresponding developing devices 5.

In order to protect the surface of the intermediate transfer belt 8, a lubricant may be supplied to the surface of the intermediate transfer belt 8 by the second cleaning brush roller 106. In such a case, a solid lubricant contacts the second cleaning brush roller 106 to be supplied to the surface of the intermediate transfer belt 8. In addition, a blade that levels the lubricant supplied to the surface of the intermediate transfer belt 8 may be provided downstream from the second cleaning brush roller 106. Alternatively, a dedicated brush for supplying the lubricant to the intermediate transfer belt 8 may be provided separately from the second cleaning brush roller 106. In a case in which the second cleaning brush roller 106 is used also for supplying the lubricant to the surface of the intermediate transfer belt 8, the toner collected by the second cleaning brush roller 106 may be mixed with the lubricant. Consequently, the collected toner may be reattached to the surface of the intermediate transfer belt 8 upon supply of the lubricant to the surface of the intermediate transfer belt 8. By contrast, provision of the brush dedicated for supplying the lubricant to the surface of the intermediate transfer belt 8 can prevent the collected toner from reattaching to the surface of the intermediate transfer belt 8.

A description is now given of an example of a configuration of the components provided to the belt cleaning device 100.

With regard to the configuration of the first cleaning brush roller 102, the bristles are formed of conductive polyester and have a core-in-sheath-type structure in w conductive carbon is included within each bristle and a surface of the bristle is coated with polyester. The first cleaning brush roller 102 has a resistivity of $1\times10^7\Omega$ and a diameter of 15 mm, contacts the intermediate transfer belt 8 against the direction of rotation of the intermediate transfer belt 8 with an engagement of 1 mm, and is rotated at 480 rpm.

With regard to the configuration of the second cleaning brush roller 106, the bristles are likewise formed of conductive polyester and have a core-in-sheath type structure in which conductive carbon is included within each bristle and a surface of the bristle is coated with polyester. The second cleaning brush roller 106 has a resistivity of $1\times10^7\Omega$ and a diameter of 15 mm, contacts the intermediate transfer belt 8 against the direction of rotation of the intermediate transfer belt 8 with an engagement of 1 mm, and is rotated at 480 rpm.

Although the bristles of each of the first and second cleaning brush rollers 102 and 106 are conductive, the surface of each of the bristles is coated with an insulative layer. Accordingly, an electric current tends not to flow thereto upon contact of the intermediate transfer belt 8 and each of the first and second cleaning brush rollers 102 and 106, thereby preventing unnecessary electric current flow when the bristles of each of the first and second cleaning brush rollers 102 and 106 electrostatically attract the toner from the intermediate transfer belt 8. As a result, electric charges are not injected into the toner, and the collected toner is not reattached to the intermediate transfer belt 8.

However, in the event that a voltage strong enough to destroy the insulative layer of each of the bristles to flow an electric current is supplied to the rotary shaft of each of the first and second cleaning brush rollers 102 and 106, the collected toner is reattached to the intermediate transfer belt 8. Therefore, it is necessary to appropriately set the voltage to a value that prevents reattachment of the collected toner to the intermediate transfer belt 8.

In addition, the configuration of the bristles of each of the first and second cleaning brush rollers 102 and 106 is not limited to the above-described examples. Thus, for example, the insulative layer of each of the bristles may be coated with a conductive layer, or conductive members may be dispersed among the bristles to adjust the voltage appropriately.

Each of the bristles of the first and second cleaning brush rollers 102 and 106 is bent to the same side so that the conductive material exposed on a cross-section of each of the bristles tends not to contact the intermediate transfer belt 8. As a result, electric charge injection into the toner is prevented, thereby enhancing cleaning performance. The same effects can be achieved when the bristles are formed of a well-known insulative material such as nylon, polyester, and acrylic. It is to be noted that a well-known core-in-sheath-type structure of the bristles is disclosed in Published unexamined Japanese Patent Applications No. H10-310974-A, H10-131035-A, and H01-292116-A and Published examined Japanese Patent Applications No. H07-033637-B, H07-033606-B, and H03-064604-B.

The first collection roller 103 is an SUS roller and has a diameter of 14 mm, and is rotated at 480 rpm. The first collection roller 103 contacts the first cleaning brush roller 102 against the direction of rotation of the first cleaning brush roller 102 with an engagement of 1.5 mm.

The second collection roller 107 is an SUS roller and has a diameter of 14 mm, and is rotated at 480 rpm. The second collection roller 107 contacts the second cleaning brush roller 106 against the direction of rotation of the second cleaning brush roller 106 with an engagement of 1.5 mm.

Alternatively, each of the first and second collection rollers 103 and 107 may be a conductive metal core coated with a high-resistance elastic tube having a thickness of from several μm to 100 μm, and the conductive metal core may be further coated with an insulating material. Specific examples of materials for use in the surface of each of the first and second collection rollers 103 and 107 include, but are not limited to, a PVDF tube, a PFA tube, a PI tube, an acryl coating, a silicone coating (for example, coating with PC (polycarbonate) including silicone particles), ceramics, and fluorine coating.

The first scraper 104 is formed of SUS and has a thickness of 100 μm. The first scraper 104 contacts the surface of the first collection roller 103 with an engagement of 0.6 mm at a contact angle of 20°.

The second scraper 108 is formed of SUS and has a thickness of 100 μm. The second scraper 108 contacts the surface of the second collection roller 107 with an engagement of 0.6 mm at a contact angle of 20°.

An example of a voltage supplied to each of the first and second cleaning brush rollers 102 and 106 and the first and second collection rollers 103 and 107 is shown in Table 1 below.

TABLE 1

| | Cleaning Brush Roller | Collection Roller |
|---|---|---|
| First Cleaning Part 100a | +2,800 V | +3,200 V |
| Second Cleaning Part 100b | −2,000 V | −2,400 V |

The intermediate transfer belt 8 is an elastic belt and has a thickness of 500 μm. The intermediate transfer belt 8 is rotated at a speed of 350 mm/s. Each of the first and second opposing rollers 13 and 14 is formed of aluminum and has a diameter of 1.4 mm.

Untransferred toner, which is not transferred onto the sheet P at the secondary transfer nip and remains attached to the intermediate transfer belt 8 after passing through the secondary transfer nip, is conveyed to the first cleaning brush roller 102 by the rotation of the intermediate transfer belt 8. As described above, the positive voltage having a polarity opposite the normal charging polarity of toner is supplied to the first cleaning brush roller 102. Accordingly, negatively charged toner in the untransferred toner on the intermediate transfer belt 8 is electrostatically attached to the first cleaning brush roller 102 by an electric field formed by a potential difference between the intermediate transfer belt 8 and the first cleaning brush roller 102. Then, the negatively charged toner attached to the first cleaning brush roller 102 is conveyed to a contact position where the first cleaning brush roller 102 contacts the first collection roller 103, to which the positive voltage greater than the voltage supplied to the first cleaning brush roller 102 is supplied. At the contact position, the toner on the first cleaning brush roller 102 is electrostatically attached to the first collection roller 103 by an electric field formed by a potential difference between the first cleaning brush roller 102 and the first collection roller 103. The negatively charged toner thus attached to the first collection roller 103 is then scraped off from the first collection roller 103 by the first scraper 104. The toner thus scraped off is discharged from the belt cleaning device 100 by the discharge screw 109.

Positively charged toner in the untransferred toner which cannot be removed by the first cleaning brush roller 102 and still remains on the intermediate transfer belt 8 after passing through the first cleaning brush roller 102 is further conveyed to the second cleaning brush roller 106. As described above, the negative voltage having the same polarity as the normal charging polarity of toner is supplied to the second cleaning brush roller 106. Accordingly, the positively charged toner on the intermediate transfer belt 8 is electrostatically attached to the second cleaning brush roller 106 by an electric field formed by a potential difference between the intermediate transfer belt 8 and the second cleaning brush roller 106. Then, the positively charged toner attached to the second cleaning brush roller 106 is conveyed to a contact position where the second cleaning brush roller 106 contacts the second collection roller 107, to which the negative voltage greater than the voltage supplied to the second cleaning brush roller 106 is supplied. At the contact position, the toner on the second cleaning brush roller 106 is electrostatically attached to the second collection roller 107 by an electric field formed by a potential difference between the second cleaning brush roller 106 and the second collection roller 107. The positively charged toner thus attached to the second collection roller 107 is then scraped off from the second collection roller 107 by the second scraper 108. The toner thus scraped off is discharged from the belt cleaning device 100 by the discharge screw 109.

A description is now given of features of the image forming apparatus 50.

In the image forming apparatus 50, a toner pattern such as the graduation patterns S, the chevron patch, and the toner consumption pattern is formed on the intermediate transfer belt 8 to provide higher image quality. The toner pattern thus formed on the intermediate transfer belt 8 is removed by the belt cleaning device 100 without being transferred onto the sheet P. The toner pattern is charged substantially to the normal charging polarity of toner, that is, the negative polarity. Therefore, much of the toner pattern is removed from the intermediate transfer belt 8 by the first cleaning brush roller 102. Because the toner pattern contains a larger amount of toner, such a larger amount of toner is attached to the first cleaning brush roller 102 when the toner pattern is removed from the intermediate transfer belt 8 by the first cleaning brush roller 102. The larger amount of toner thus attached to the first cleaning brush roller 102 is electrostatically moved to the first collection roller 103.

However, a part of the toner may remain attached to the first cleaning brush roller 102 without electrostatically moving to the first collection roller 103 because the larger amount of toner attached to the first cleaning brush roller 102 exceeds the collection capacity of the first collection roller 103. The toner remaining attached to the first cleaning brush roller 102 reduces an amount of toner that newly attaches to the bristles of the first cleaning brush roller 102 when the bristles contact the intermediate transfer belt 8 again by the rotation of the first cleaning brush roller 102, thereby degrading cleaning performance.

The first cleaning brush roller 102 is rotated at a rotary speed R of 480 rpm, and the intermediate transfer belt 8 is moved at a speed V of 350 mm/s. Therefore, a relation of $(60/R)>(L/V)$ is satisfied to remove the toner pattern from the intermediate transfer belt 8 while the first cleaning brush roller 102 makes a single rotation as long as a length L of the toner pattern is not greater than 43.8 mm. A length of the toner consumption pattern is 30 mm, and a length of each set of the chevron patch is 36 mm. Thus, the relation of $(60/R)>(L/V)$ is satisfied to remove the toner consumption pattern or the chevron patch from the intermediate transfer belt 8 while the first cleaning brush roller 102 makes a single rotation.

However, each of the graduation patterns S is constructed of ten patches, each having a length of 10 mm, and the patches are formed at intervals of 2 mm. As a result, a total length of each of the graduation patterns S is 118 mm, and therefore, the relation of $(60/R)>(L/V)$ is not satisfied. Consequently, the graduation patterns S cannot be removed from the intermediate transfer belt 8 while the first cleaning brush roller 102 makes a single rotation.

Also, as described above, because part of the toner remains attached to the bristles of the first cleaning brush roller 102 during the second rotation of the first cleaning brush roller 102, cleaning performance of the first cleaning brush roller 102 is degraded at this time. Consequently, much of the negatively charged toner that accounts for a majority of the toner pattern cannot be completely removed from the intermediate transfer belt 8 while the first cleaning brush roller 102 makes the second rotation. The second cleaning brush roller 106 provided downstream from the first cleaning brush roller 102 does not electrostatically remove the negatively charged toner from the intermediate transfer belt 8, causing irregular cleaning.

Figure 6:
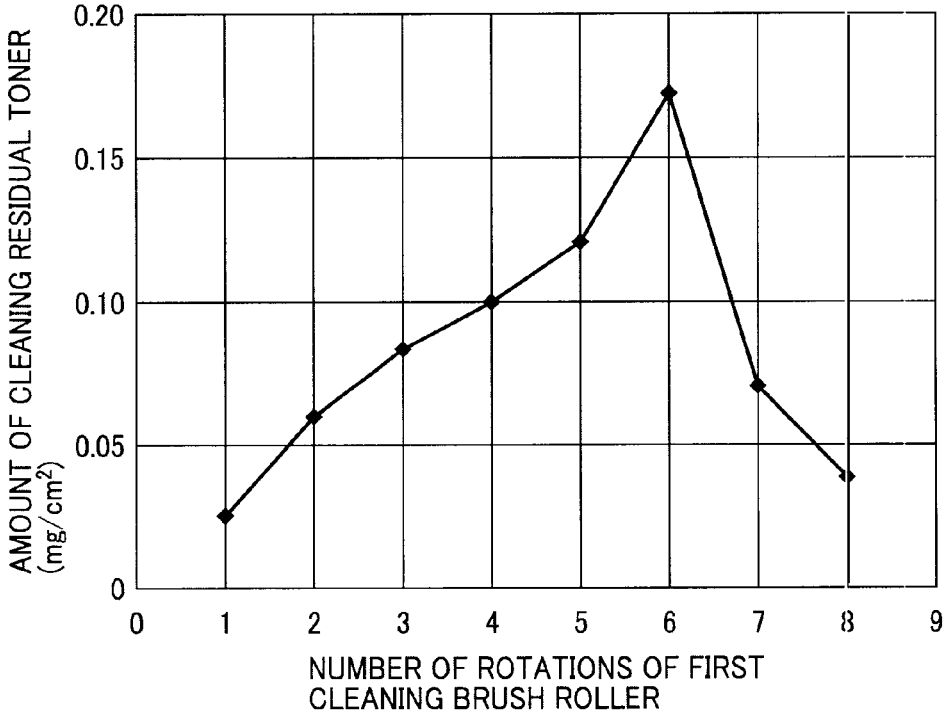
FIG. 6 is a graph showing a relation between number of rotations of a first cleaning brush roller and cleaning performance obtained by performing an evaluation test.
Figure 7:
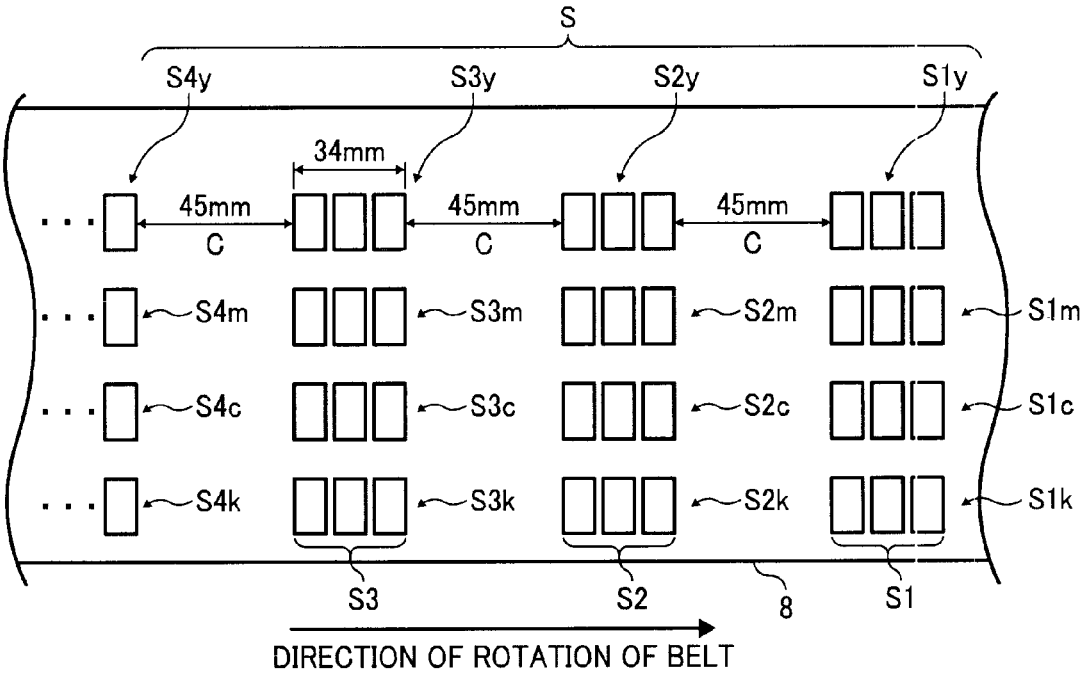
FIG. 7 is a schematic view illustrating a graduation pattern divided into multiple sub-patterns.

FIG. 6 is a graph showing a relation between number of rotations of the first cleaning brush roller 102 and cleaning performance obtained by performing an evaluation test.

In the evaluation test, the second cleaning brush roller 106 was detached from the belt cleaning device 100 and an untransferred A4-size toner image having a toner density of 0.9 mg/cm$^2$ was conveyed to the belt cleaning device 100 to find an amount of toner still remaining on the intermediate transfer belt 8 after passing through the first cleaning brush roller 102. An amount of toner remaining on the intermediate transfer belt 8 each time the first cleaning brush roller 102 made a single rotation was measured as an amount of cleaning residual toner. It is to be noted that the evaluation test was performed under the same cleaning conditions as those in the foregoing illustrative embodiment. As shown in FIG. 6, an amount of cleaning residual toner while the first cleaning brush roller 102 made the first rotation was not greater than 0.05 mg/cm$^2$. An amount of cleaning residual toner not greater than 0.05 mg/cm$^2$ can be mechanically removed by the second cleaning brush roller 106, which was not provided in the present evaluation test though, and does not adversely affect image quality. However, an amount of cleaning residual toner exceeded 0.05 mg/cm$^2$ on and after the first cleaning brush roller 102 made the second rotation. Thereafter, the amount of cleaning residual toner increased as the number of rotations of the first cleaning brush roller 102 increased.

It is probable that the amount of cleaning residual toner gradually increased because the amount of toner accumulating on the first cleaning brush roller 102 with the increase in the number of rotations of the first cleaning brush roller 102 exceeded the toner collection capacity of the first collection roller 103. As shown in FIG. 6, the cleaning residual toner was generated even while the first cleaning brush roller 102 made the seventh rotation in spite of the fact that no untransferred toner was conveyed to the belt cleaning device 100 after the sixth rotation of the first cleaning brush roller 102. A part of the larger amount of toner remaining attached to the first cleaning brush roller 102 without being collected by the first collection roller 103 was reattached to the intermediate transfer belt 8, causing the generation of the cleaning residual toner even when no untransferred toner was conveyed to the belt cleaning device 100. In the evaluation test, the toner remaining attached to the first cleaning brush roller 102 was reattached to the intermediate transfer belt 8 during the eighth rotation of the first cleaning brush roller 102 because the first collection roller 103 could not fully collect the toner from the first cleaning brush roller 102 even when the first cleaning brush roller 102 made an additional single rotation while no untransferred toner was conveyed to the belt cleaning device 100. Consequently, as described above, the cleaning residual toner was found during the eighth rotation of the first cleaning brush roller 102. It is likely that the accumulated amount of toner remaining attached to the first cleaning brush roller 102 while the first cleaning brush roller 102 made six consecutive rotations was too large to be collected by the first collection roller 103 even when the first cleaning brush roller 102 made the additional single rotation. However, the first collection roller 103 could substantially collect the toner attached to the first cleaning brush roller 102 only during the first rotation of the first cleaning brush roller 102 when the first cleaning brush roller 102 made an additional single rotation while no untransferred toner was conveyed to the belt cleaning device 100.

As described above, the amount of cleaning residual toner exceeds 0.05 mg/cm$^2$ on or after the first cleaning brush roller 102 made the second rotation, thereby possibly causing irregular cleaning. Therefore, it is preferable that the toner pattern be removed from the intermediate transfer belt 8 by the first cleaning brush roller 102 while the first cleaning brush roller 102 makes a single rotation.

In the present illustrative embodiment, each of the graduation patterns S is constructed of multiple sub-patterns S1*y*, S1*m*, S1*c*, or S1*k* (hereinafter collectively referred to as S1), S2*y*, S2*m*, S2*c*, or S2*k* (hereinafter collectively referred to as S2), S3*y*, S3*m*, S3*c*, or S3*k* (hereinafter collectively referred to as S3), and so on, arranged side by side at equal intervals. Each of the sub-patterns S1, S2, S3, and so on is constructed of three patches. A length L of each of the sub-patterns S1, S2, S3, and so on is 34 mm, and an interval C between the sub-patterns S1, S2, S3, and so on is set to 45 mm, which is greater than 43.8 mm. As a result, the relation of (60/R)>(L/V) is satisfied upon removal of the single sub-pattern S1, S2, S3, or the like included in each of the graduation patterns S, thereby reliably removing the single sub-pattern S1, S2, S3, or the like while the first cleaning brush roller 102 makes a single rotation. In addition, the relation of (60/R)<(C/V) is also satisfied by setting the interval C between the sub-patterns S1, S2, S3, and so on to not less than 43.8 mm. Accordingly, the next sub-pattern S2, S3, S4, or the like is removed by the first cleaning brush roller 102 after the first cleaning brush roller 102 makes an additional single rotation after the previous sub-pattern S1, S2, S3, or the like is removed. As a result, the first cleaning brush roller 102, from which the toner is fully collected by the first collection roller 103, removes the next sub-pattern S2, S3, S4, or the like from the intermediate transfer belt 8, hereby achieving higher cleaning performance.

In the foregoing illustrative embodiment, the control unit 200 that controls image formation performed by the image forming apparatus 50 shortens the length L of each of the sub-patterns S1, S2, S3, and so on to satisfy the relation of (60/R)>(L/V). Alternatively, the number of rotations R of the first cleaning brush roller 102 may be controlled in place of the length L to satisfy the relation of (60/R)>(L/V). For example, when the number of rotations R of the first cleaning brush roller 102 is set to 160 rpm, the sub-pattern S1, S2, S3, or the like each having a length L of 131.3 mm can be removed by the first cleaning brush roller 102 while the first cleaning brush roller 102 makes a single rotation. Therefore, the graduation patterns S need not be constructed of the multiple sub-patterns S1, S2, S3, and so on, and even ten successive patches can be removed from the intermediate transfer belt 8 while the first cleaning brush roller 102 makes a single rotation. In such a case, the number of rotations R of the first cleaning brush roller 102 is reduced from 480 rpm to 160 rpm upon image density control to reliably remove the graduation patterns S from the intermediate transfer belt 8. However, the reduction of the number of rotations R of the first cleaning brush roller 102 reduces chances in which the bristles of the first cleaning brush roller 102 contact the untransferred toner on the intermediate transfer belt 8 while the untransferred toner passes through the cleaning nip between the first cleaning brush roller 102 and the intermediate transfer belt 8. Consequently, an amount of toner electrostatically attached to each bristle of the first cleaning brush roller 102 is increased. Because the amount of toner held by each bristle of the first cleaning brush roller 102 is limited, too much reduction of the number of rotations R of the first cleaning brush roller 102 may degrade cleaning performance.

Table 2 below shows cleaning performance of the first cleaning brush roller 102 at a different linear velocity ratio between the first cleaning brush roller 102 and the intermediate transfer belt 8. Similar to the above-described evaluation test, the second cleaning brush roller 106 was detached from the belt cleaning device 100, and only the first cleaning part 100*a* was used to find a cleaning residual ID on the intermediate transfer belt 8. A tape having the same width as A3 paper was equally divided into three parts and adhered onto the intermediate transfer belt 8 in a width direction of the intermediate transfer belt 8 after passing through the first cleaning brush roller 102 so that the toner remaining on the intermediate transfer belt 8 was transferred onto the divided tapes. Then, each tape was adhered onto a sheet of paper to measure a toner density of each tape as a cleaning residual ID. In Table 2 below, F represents a cleaning residual ID of a tape adhered onto a front edge of the intermediate transfer belt 8 in the width direction thereof, C represents a cleaning residual ID of a tape adhered onto the center of the intermediate transfer belt 8, and R represents a cleaning residual ID of a tape adhered onto a rear edge of the intermediate transfer belt 8.

TABLE 2

| Cleaning | Linear Velocity Ratio | |
|---|---|---|
| Residual ID | 1/1 | 1/5 |
| F | 0.124 | 0.222 |
| C | 0.150 | 0.249 |
| R | 0.208 | 0.262 |
| Average | 0.161 | 0.244 |

As shown in Table 2, the cleaning residual IDs at the number of rotations R of 96 rpm with the linear velocity ratio of 1 to 5 are one-and-a-half times greater than those at the number of rotations R of 480 rpm with the linear velocity ratio of 1 to 1. In addition, when both the first and second cleaning brush rollers 102 and 106 were attached to the belt cleaning device 100 and the sheet P was fed at the linear velocity ratio of 1 to 5, the untransferred toner remaining on the intermediate transfer belt 8 was inadvertently transferred onto the sheet P, causing an irregular image.

One method for reducing the number of rotations R of the first cleaning brush roller 102 without reducing the linear velocity ratio between the first cleaning brush roller 102 and the intermediate transfer belt 8 is to increase a diameter of the first cleaning brush roller 102. The first cleaning brush roller 102 having a larger diameter increases a linear velocity of the first cleaning brush roller 102 without changing the number of rotations R of the first cleaning brush roller 102.

Specifically, cleaning performance can be maintained by satisfying a relation of $2\pi r \times (R/60) > (V*X)$, where r is an effective radius of the first cleaning brush roller 102 and X is the minimum linear velocity ratio that can maintain cleaning performance. The effective radius r is obtained by subtracting an amount of engagement of the first cleaning brush roller 102 with the intermediate transfer belt 8 from the radius of the first cleaning brush roller 102. The first cleaning brush roller 102 contacts the intermediate transfer belt 8 with an engagement of not less than 0.5 mm. A smaller amount of engagement of the first cleaning brush roller 102 with the intermediate transfer belt 8 reduces a mechanical force in which the first cleaning brush roller 102 contacts the intermediate transfer belt 8, possibly causing irregular cleaning. In addition, the effective radius r of the first cleaning brush roller 102 is used to obtain a linear velocity of the first cleaning brush roller 102 at the cleaning nip. Further, when the linear velocity ratio is 1 to 5, the minimum linear velocity ratio X is 0.2, which can be easily obtained by an experiment.

Alternatively, the speed V of the intermediate transfer belt 8 may be controlled to satisfy the relation of $(60/R) > (L/V)$. In such a case, the control unit 200 accelerates the speed V of the intermediate transfer belt 8 after the graduation patterns S are transferred onto the intermediate transfer belt 8. However, too much increase in the speed V of the intermediate transfer belt 8 reduces the linear velocity ratio between the intermediate transfer belt 8 and the first cleaning brush roller 102 at the cleaning nip, thereby causing irregular cleaning for the same reasons described above. Therefore, the speed V of the intermediate transfer belt 8 is accelerated such that the relation of $2\pi r \times (R/60) > (V*X)$ is satisfied.

Although one of the length L of each of the sub-patterns S1, S2, S3, and so on, the number of rotations R of the first cleaning brush roller 102, and the speed V of the intermediate transfer belt 8 is controlled in the foregoing illustrative embodiment, the above-described control may be performed in combination. For example, upon removal of the graduation patterns S from the intermediate transfer belt 8, the number of rotations R of the first cleaning brush roller 102 may be reduced and the speed V of the intermediate transfer belt 8 after the transfer of the graduation patterns S onto the intermediate transfer belt 8 may be accelerated to satisfy the relation of $(60/R) > (L/V)$.

A description is now given of a second illustrative embodiment of the present invention. In the second illustrative embodiment, the belt cleaning device 100 further includes a pre-cleaning part 100*c* provided upstream from both the first and seco rid cleaning parts 100*a* and 100*b* such that much of an untransferred toner image such as the toner pattern may be removed from the intermediate transfer belt 8 by the pre-cleaning part 100*c*.

Figure 8:
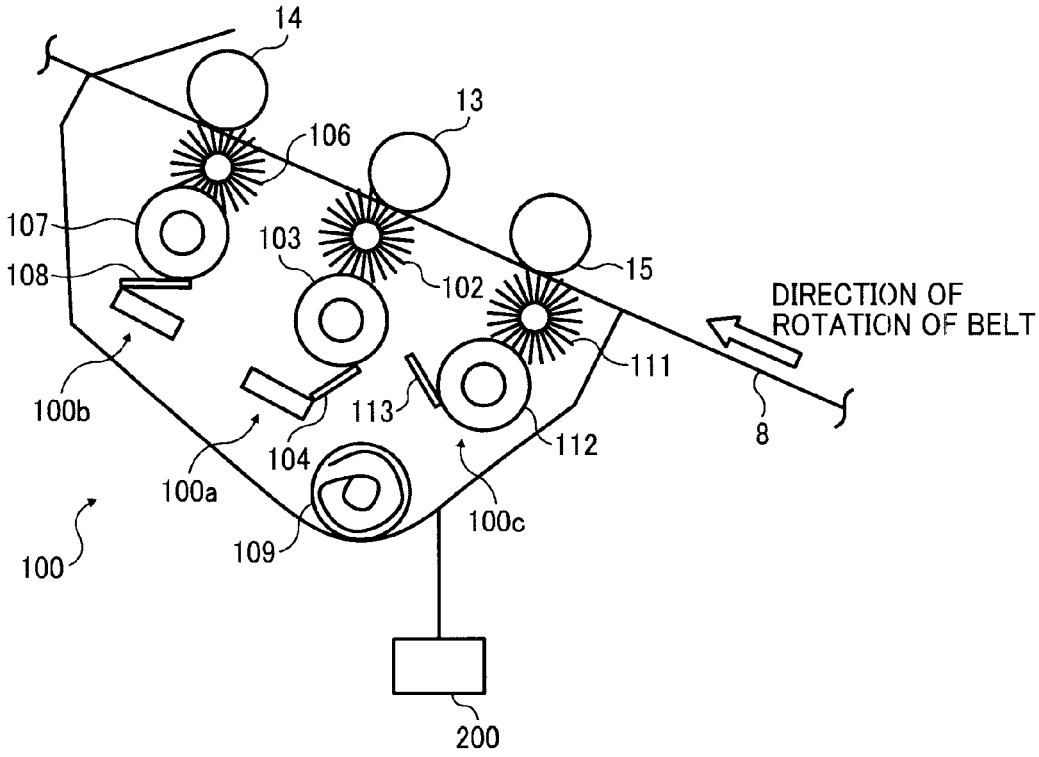
FIG. 8 is a schematic view illustrating an example of a configuration of a belt cleaning device and surrounding components according to a second illustrative embodiment.

FIG. 8 is a schematic view illustrating an example of a configuration of the belt cleaning device 100 according to the second illustrative embodiment.

The pre-cleaning part 100*c* includes a pre-cleaning brush roller 111 serving as a pre-cleaning member, a pre-collection roller 112 serving as a pre-collection member that collects toner attached to the pre-cleaning brush roller 111, and a pre-scraper 113 that contacts the pre-collection roller 112 to scrape off the toner from a surface of the pre-collection roller 112. A pre-opposing roller 15 is provided opposite the pre-cleaning brush roller 111 with the intermediate transfer belt 8 interposed therebetween.

In the belt cleaning device 100 according to the second illustrative embodiment, a negative voltage having the same polarity as the normal charging polarity of toner is supplied to the first cleaning brush roller 102 to remove the positively charged toner from the intermediate transfer belt 8. In addition, a positive voltage is supplied to each of the pre-cleaning brush roller 111 and the second cleaning brush roller 106 to remove the negatively charged toner from the intermediate transfer belt 8. An example of a voltage supplied to the metal core of each of the pre-cleaning brush roller 111, the first cleaning brush roller 102, and the second cleaning brush roller 106 is shown in Table 3 below.

TABLE 3

| | Cleaning Brush Roller | Collection Roller |
|---|---|---|
| Pre-Cleaning Part 100c | +2,800 V | +3,200 V |
| First Cleaning Part 100a | −3,200 V | −3,600 V |
| Second Cleaning Part 100b | −1,200 V | +1,600 V |

As shown in Table 3 above, a positive voltage greater than the voltage supplied to the second cleaning brush roller 106 is supplied to the pre-cleaning brush roller 111 in order to remove a larger amount of negatively charged toner from the intermediate transfer belt 8. In addition, the voltage supplied to the first cleaning brush roller 102 is increased so that the first cleaning brush roller 102 functions also as a polarity controller that supplies a negative electric charge to the toner on the intermediate transfer belt 8 to give the toner the normal charging polarity, that is, the negative polarity. As a result, the untransferred toner is reliably removed from the intermediate transfer belt 8.

The toner pattern formed on the intermediate transfer belt 8 is conveyed to the pre-cleaning brush roller 111 by the rotation of the intermediate transfer belt 8. As described above, the positive voltage is supplied to the pre-cleaning brush roller 111. Accordingly, the negatively charged toner on the intermediate transfer belt 8 is electrostatically attached to the pre-cleaning brush roller 111 by an electric field formed by a potential difference between the intermediate transfer belt 8 and the pre-cleaning brush roller 111. Therefore, much of the toner pattern is removed from the intermediate transfer belt 8 by the pre-cleaning brush roller 111. Accordingly, an amount of toner further conveyed to the first and second c leaning parts 100*a* and 100*b* can be reduced. As a result, the reduced amount of toner still remaining on the intermediate transfer belt 8 can be reliably removed by the first and second cleaning parts 100*a* and 100*b*. Thus, even the untransferred toner image containing a larger amount of toner can be reliably removed from the intermediate transfer belt 8 by the belt cleaning device 100 according to the second illustrative embodiment.

In the second illustrative embodiment, a relation of (60/R)>(L/V), where R is number of rotations of the pre-cleaning brush roller 111, V is the speed of the intermediate transfer belt 8, and L is the length of each of the sub-patterns S1, S2, S3, and so on in the graduation patterns S, is satisfied to remove the single sub-pattern S1, S2, S3, or the like from the intermediate transfer belt 8 while the pre-cleaning brush roller 111 makes a single rotation. As a result, each of the sub-patterns S1, S2, S3, and so on in the graduation patterns S can be reliably removed from the intermediate transfer belt 8 by the pre-cleaning part 100*c*, thereby achieving higher cleaning performance. In addition, a relation of (60/R)<(C/V), where C is the interval between each of the sub-patterns S1, S2, S3, and so on formed on the intermediate transfer belt 8, is satisfied to remove the next sub-pattern S2, S3, S4, or the like from the intermediate transfer belt 8 after the pre-cleaning brush roller 111 makes an additional single rotation after the previous sub-pattern S1, S2, S3, or the like is removed from the intermediate transfer belt 8 by the pre-cleaning brush roller 111.

A description is now given of toner used in the image forming apparatus 50 according to illustrative embodiments.

In order to satisfy increasing demand for higher quality images, a volume average particle diameter (Dv) of the toner is preferably in a range between 3 μm and 6 μm to reproduce microdots not less than 600 dpi. A ratio (Dv/Dn) of the volume average particle diameter (Dv) to the number average particle diameter (Dn) of the toner is preferably in a range between 1.00 and 1.40. As the ratio (Dv/Dn) approaches 1, the particle diameter distribution becomes narrower. The toner having a smaller particle diameter and a narrower particle diameter distribution can be uniformly charged and transferred, and therefore higher quality images without background fogging can be produced, and a higher transfer rate can be achieved in the image forming apparatus 50 employing the electrostatic transfer system.

Figure 9:
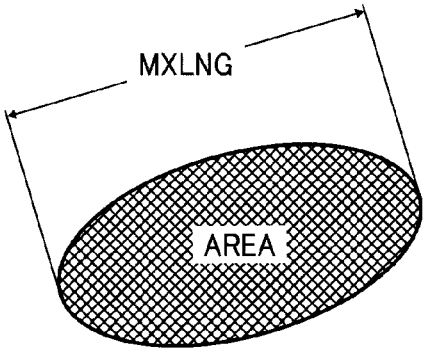
FIG. 9 is a schematic view illustrating a shape of a toner particle for explaining shape factor SF-1.

The toner having high circularity with a shape factor SF-1 of from 100 to 180 and a shape factor SF-2 of from 100 to 180 is used in the image forming apparatus 50 according to illustrative embodiments. FIG. 9 is a schematic view illustrating a shape of toner for explaining the shape factor SF-1. As illustrated in FIG. 9, the shape factor SF-1 represents a degree of roundness of a toner particle, and is determined in accordance with the following formula (1). The shape factor SF-1 is obtained by dividing the square of the maximum length MXLNG of the shape produced by projecting the toner particle in a two-dimensional plane, by the figural surface area AREA, and subsequently multiplying by 100π/4.

$$SF\text{-}1=\{(MXLNG)^2/AREA\}\times(100\pi/4) \quad (1)$$

When SF-1 is 100, the toner particle has a shape of a complete sphere. As SF-1 becomes greater, the toner particle becomes more amorphous.

Figure 10:
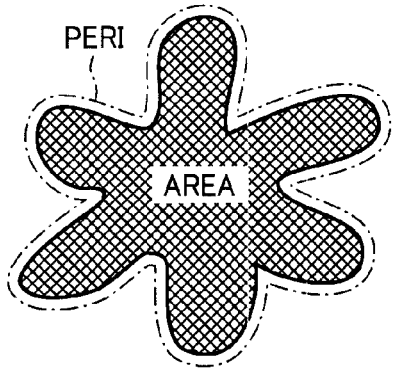
FIG. 10 is a schematic view illustrating a shape of a toner particle for explaining shape factor SF-2.

FIG. 10 is a schematic view illustrating a shape of toner for explaining the shape factor SF-2. As illustrated in FIG. 10, the shape factor SF-2 represents a concavity and convexity of the shape of the toner particle, and is determined in accordance with the following formula (2). The shape factor SF-2 is obtained by dividing the square of the perimeter PERI of the figure produced by projecting the toner particle in a two-dimensional plane, by the figural surface area AREA, and subsequently multiplying by 100π/4.

$$SF\text{-}2=\{(PELI)^2/AREA\}\times(100\pi/4) \quad (2)$$

When SF-2 is 100, the surface of the toner particle has no concavities and convexities. As SF-2 becomes greater, the concavities and convexities thereon become more noticeable.

The shape factors can be measured by taking a picture of the toner particle with a scanning electron microscope S-800 manufactured by Hitachi, Ltd., and analyzing the picture with an image analyzer LUSEX 3 manufactured by Nireco Corporation to calculate the shape factors. When a shape of the toner particle becomes close to a sphere, toner particles contact each other as well as the photoconductors 1 in a point contact manner. Consequently, absorbability between the toner particles decreases, resulting in an increase in fluidity. Moreover, absorbability between the toner particles and the photoconductors 1 decreases, resulting in an increase in a transfer rate. When either the shape factor SF-1 or SF-2 is too large, the transfer rate deteriorates.

The toner preferably used for image formation performed by the image forming apparatus 50 is obtained by a cross-linking reaction and/or an elongation reaction of a toner constituent liquid in an aqueous solvent. Here, the toner constituent liquid is prepared by dispersing a polyester prepolymer including a functional group having at least a nitrogen atom, a polyester, a colorant, and a releasing agent in an organic solvent. A description is now given of toner constituents and a method for manufacturing toner.

(Polyester)

The polyester is prepared by a polycondensation reaction between a polyalcohol compound and a polycarboxylic acid compound.

Specific examples of the polyalcohol compound (PO) include a diol (DIO) and a polyol having 3 or more valances (TO). The DIO alone, and a mixture of the DIO and a smaller amount of the TO are preferably used as the PO. Specific examples of the diol (DIO) include alkylene glycols (e.g., ethylene glycol, 1,2-propylene glycol, 1,3-propylene glycol, 1,4-butanediol, and 1,6-hexanediol), alkylene ether glycols (e.g., diethylene glycol, triethylene glycol, dipropyrene glycol, polyethylene glycol, polypropylene glycol, and polytetramethylene ether glycol), alicyclic diols (e.g., 1,4-cyclohexane dimethanol, and hydrogenated bisphenol A), bisphenols (e.g., bisphenol A, bisphenol F, and bisphenol S), alkylene oxide adducts of the above-described alicyclic diols (e.g., ethylene oxide, propylene oxide, and butylene oxide), and alkylene oxide adducts of the above-described bisphenols (e.g., ethylene oxide, propylene oxide, and butylene oxide). Among the above-described examples, alkylene glycols having 2 to 12 carbon atoms and alkylene oxide adducts of bisphenols are preferably used. More preferably, the alkylene glycols having 2 to 12 carbon atoms and the alkylene oxide adducts of bisphenols are used together. Specific examples of the polyol having 3 or more valances (TO) include aliphatic polyols having 3 to 3 or more valances (e.g., glycerin, trimethylolethane, trimethylol propane, pentaerythritol, and sorbitol), phenols having 3 or more valances (e.g., trisphenol PA, phenol novolac, and cresol novolac), and alkylene oxide adducts of polyphenols having 3 or more valances.

Specific examples of the polycarboxylic acids (PC) include dicarboxylic acids (DIC) and polycarboxylic acids having 3 or more valances (TC). The DIC alone, and a mixture of the DIC and a smaller amount of the TC are preferably used as the PC. Specific examples of the dicarboxylic acids (DIC) include alkylene dicarboxylic acids (e.g., succinic acid, adipic acid, and sebacic acid), alkenylene dicarboxylic acids (e.g., maleic acid and fumaric acid), and aromatic dicarboxylic acids (e.g., phthalic acid, isophthalic acid, terephthalic acid, and naphthalene dicarboxylic acid). Among the above-described examples, alkenylene dicarboxylic acids having 4 to 20 carbon atoms and aromatic dicarboxylic acids having 8 to 20 carbon atoms are preferably used. Specific examples of the polycarboxylic acids having 3 or more valances (TC) include aromatic polycarboxylic acids having 9 to 20 carbon atoms (e.g., trimellitic acid and pyromellitic acid). The polycarboxylic acid (PC) may be reacted with the polyol (PO) using acid anhydrides or lower alkyl esters (e.g., methyl ester, ethyl ester, and isopropyl ester) of the above-described materials.

A ratio of the polyol (PO) and the polycarboxylic acid (PC) is normally set in a range between 2/1 and 1/1, preferably between 1.5/1 and 1/1, and more preferably between 1.3/1 and 1.02/1 as an equivalent ratio [OH]/[COOH] between a hydroxyl group [OH] and a carboxyl group [COOH]. The polycondensation reaction between the polyol (PO) and the polycarboxylic acid (PC) is carried out by heating the PO and the PC to from 150° C. to 280° C. in the presence of a known catalyst for esterification such as tetrabutoxy titanate and dibutyltin oxide and removing produced water under a reduced pressure as necessary to obtain a polyester having hydroxyl groups. The polyester preferably has a hydroxyl value not less than 5, and an acid value of from 1 to 30, and preferably from 5 to 20. When the polyester has the acid value within the range, the resultant toner tends to be negatively charged to have good affinity with a recording paper, and lower-temperature fixability of the toner on the recording paper improves. However, when the acid value is too large, the resultant toner is not stably charged and the stability becomes worse by environmental variations. The polyester preferably has a weight-average molecular weight of from 10,000 to 400,000, and more preferably from 20,000 to 200,000. When the weight-average molecular weight is too small, offset resistance of the resultant toner deteriorates. By contrast, when the weight-average molecular weight is too large, lower-temperature fixability thereof deteriorates.

The polyester preferably includes a urea-modified polyester as well as an unmodified polyester obtained by the above-described polycondensation reaction. The urea-modified polyester is prepared by reacting a polyisocyanate compound (PIC) with a carboxyl group or a hydroxyl group at the end of the polyester obtained by the above-described polycondensation reaction to form a polyester prepolymer (A) having an isocyanate group, and reacting amine with the polyester prepolymer (A) to crosslink and/or elongate a molecular chain thereof. Specific examples of the polyisocyanate compound (PIC) include aliphatic polyisocyanates (e.g., tetramethylene diisocyanate, hexamethylene diisocyanate, and 2,6-diisocyanate methylcaproate), alicyclic polyisocyanates (e.g., isophoron diisocyanate and cyclohexyl methane diisocyanate), aromatic diisocyanates (e.g. trilene diisocyanate and diphenylmethane diisocyanate), aromatic aliphatic diisocyanates (e.g., α,α, α',α'-tetramethyl xylylene diisocyanate), isocyanurates, materials blocked against the polyisocyanate with phenol derivatives, oxime, caprolactam or the like, and combinations of two or more of the above-described materials. The PIC is mixed with the polyester such that an equivalent ratio [NCO]/[OH] between an isocyanate group [NCO] in the PIC and a hydroxyl group [OH] in the polyester is typically in a range between 5/1 and 1/1, preferably between 4/1 and 1.2/1, and more preferably between 2.5/1 and 1.5/1. When [NCO]/[OH] is too large, lower-temperature fixability of the resultant toner deteriorates. When [NCO]/[OH] is too small, a urea content in ester of the modified polyester decreases and hot offset resistance of the resultant toner deteriorates. The polyester prepolymer (A) typically includes a polyisocyanate group of from 0.5% to 40% by weight, preferably from 1% to 30% by weight, and more preferably from 2% to 20% by weight. When the content is too small, hot offset resistance of the resultant toner deteriorates, and in addition, the heat resistance and lower-temperature fixability of the toner also deteriorate. By contrast, when the content is too large, lower-temperature fixability of the resultant toner deteriorates. The number of the isocyanate groups included in a molecule of the polyester prepolymer (A) is at least 1, preferably from 1.5 to 3 on average, and more preferably from 1.8 to 2.5 on average. When the number of the isocyanate group is too small per 1 molecule, the molecular weight of the urea-modified polyester decreases and hot offset resistance of the resultant toner deteriorates.

Specific examples of amines (B) reacted with the polyester prepolymer (A) include diamines (B1), polyamines (B2) having 3 or more amino groups, amino alcohols (B3), amino mercaptans (B4), amino acids (B5), and blocked amines (B6) in which the amines (B1 to B5) described above are blocked.

Specific examples of the diamines (B1) include aromatic diamines phenylene diamine, diethyltoluene diamine, and 4,4'-diaminodiphenyl methane), alicyclic diamines (e.g., 4,4'-diamino-3,3'-dimethyldicyclohexylmethane, diamine cyclohexane, and isophoron diamine), and aliphatic diamines (e.g., ethylene diamine, tetramethylene diamine, and hexamethylene diamine). Specific examples of the polyamines (B2) having three or more amino groups include diethylene triamine and triethylene tetramine. Specific examples of the amino alcohols (B3) include ethanol amine and hydroxyethyl aniline. Specific examples of the amino mercaptan (B4) include aminoethyl mercaptan and amino propyl mercaptan.

Specific examples of the amino acids (B5) include amino propioic acid and amino caproic acid. Specific examples of the blocked amines (B6) include ketimine compounds prepared by reacting one of the amines B1 to B5 described above with a ketone such as acetone, methyl ethyl ketone and methyl isobutyl ketone; and oxazoline compounds. Among the above-described amines (B), diamines (B1) and a mixture of the B1 and a smaller amount of B2 are preferably used.

A mixing ratio [NCO]/[NHx] of the content of isocyanate groups in the prepolymer (A) to that of amino groups in the amine (B) is typically from 1/2 to 2/1, preferably from 1.5/1 to 1/1.5, and more preferably from 1.2/1 to 1/1.2. When the mixing ratio is too large or small, molecular weight of the urea-modified polyester decreases, resulting in deterioration of hot offset resistance of the toner.

The urea-modified polyester may include a urethane bonding as well as a urea bonding. The molar ratio (urea/urethane) of the urea bonding to the urethane bonding is typically from 100/0 to 10/90, preferably from 80/20 to 20/80, and more preferably from 60/40 to 30/70. When the content of the urea bonding is too small, hot offset resistance of the resultant toner deteriorates.

The urea-modified polyester is prepared by a method such as a one-shot method. The PO and the PC are heated to from 150° C. to 280° C. in the presence of a known esterification catalyst such as tetrabutoxy titanate and dibutyltin oxide, and removing produced water while optionally depressurizing to prepare polyester having a hydroxyl group. Next, the polyisocyanate (PIC) is reacted with the polyester at from 40° C. to 140° C. to form a polyester prepolymer (A) having an isocyanate group. Further, the amines (B) are reacted with the polyester prepolymer (A) at from 0° C. to 140° C. to form a urea-modified polyester.

When the polyisocyanate (PIC), and the polyester prepolymer (A) and the amines (B) are reacted, a solvent may optionally be used. Specific examples of the solvents include inactive solvents with the PIC such as aromatic solvents (e.g., toluene and xylene), ketones (e.g., acetone, methyl ethyl ketone and methyl isobutyl ketone), esters (e.g., ethyl acetate), amides (e.g., dimethylformamide and dimethylacetamide), and ethers (e.g., tetrahydrofuran).

A reaction terminator may optionally be used in the cross-linking and/or the elongation reaction between the polyester prepolymer (A) and the amines (B) to control a molecular weight of the resultant urea-modified polyester. Specific examples of the reaction terminators include monoamines (e.g., diethylamine, dibutylamine, butylamine and laurylamine), and their blocked compounds (e.g., ketimine compounds).

The weight-average molecular weight of the urea-modified polyester is not less than 10,000, preferably from 20,000 to 10,000,000, and more preferably from 30,000 to 1,000,000. When the weight-average molecular weight is too small, hot offset resistance of the resultant toner deteriorates. The number-average molecular weight of the urea-modified polyester is not particularly limited when the above-described unmodified polyester resin is used in combination. Specifically, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000, and more preferably from 2,000 to 8,000. When the number-average molecular weight is too large, low temperature fixability of the resultant toner and glossiness of full-color images deteriorate.

A combination of the urea-modified polyester and the unmodified polyester improves low temperature fixability of the resultant toner and glossiness of full-color images produced thereby, and is more preferably used than using the urea-modified polyester alone. Further, the unmodified polyester may include modified polyester other than the urea-modified polyester.

It is preferable that the urea-modified polyester at least partially mixes with the unmodified polyester to improve the low temperature fixability and hot offset resistance of the resultant toner. Therefore, the urea-modified polyester preferably has a composition similar to that of the unmodified polyester.

A mixing ratio between the unmodified polyester and the urea-modified polyester is from 20/80 to 95/5, preferably from 70/30 to 95/5, more preferably from 75/Z5 to 95/5, and even more preferably from 80/20 to 93/7. When the content of the urea-modified polyester is too small, the hot offset resistance deteriorates, and in addition, it is disadvantageous to have both high temperature preservability and low temperature fixability.

The binder resin including the unmodified polyester and urea-modified polyester preferably has a glass transition temperature (Tg) of from 45° C. to 65° C., and preferably from 45° C. to 60° C. When the glass transition temperature is too low, the high temperature preservability of the toner deteriorates. By contrast, when the glass transition temperature is too high, the low temperature fixability deteriorates.

Because the urea-modified polyester is likely to be present on a surface of the parent toner, the resultant toner has better heat resistance preservability than known polyester toners even though the glass transition temperature of the urea-modified polyester is low.

(Colorant)

Specific examples of the colorants for use in the toner of the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR1, RN, and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL, and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peaccck Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials can be used alone or in combination. The toner preferably includes a colorant in an amount of from 1% to 15% by weight, and more preferably from 3% to 10% by weight.

The colorant for use in the present invention can be combined with a resin to be used as a master batch. Specific examples of the resin for use in the master batch include, but are not limited to, styrene polymers and substituted styrene polymers (e.g., polystyrenes, poly-p-chlorostyrenes, and polyvinyltoluenes), copolymers of vinyl compounds and the above-described styrene polymers or substituted styrene polymers, polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, paraffin waxes, etc. These resins can be used alone or in combination.

(Charge Controlling Agent)

The toner of the present invention may optionally include a charge controlling agent. Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and salicylic acid derivatives, but are not limited thereto. Specific examples of commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LR1-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among the above-described examples, materials negatively charging the toner are preferably used.

The content of the charge controlling agent is determined depending on the species of the binder resin used, and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of the developing roller attracting the toner increases, resulting in deterioration of the fluidity of the toner and image density of the toner images.

(Release Agent)

A wax for use in the toner as a release agent has a low melting point of from 50° C. to 120° C. When such a wax is included in the toner, the wax is dispersed in the binder resin and serves as a release agent at a location between a fixing roller and the toner particles. Accordingly, hot offset resistance can be improved without applying a release agent, such as oil, to the fixing roller. Specific examples of the release agent include natural waxes including vegetable waxes such as carnauba wax, cotton wax, Japan wax and rice wax; animal waxes such as bees wax and lanolin; mineral waxes such as ozokelite and ceresine; and petroleum waxes such as paraffin waxes, microcrystalline waxes, and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes, and ether waxes. Further, fatty acid amides such as 1,2-hydroxylstearic acid amide, stearic acid amide, and phthalic anhydride imide; and low molecular weight crystalline polymers such as acrylic homopolymer and copolymers having a long alkyl group in their side chain such as poly-n-stearyl methacrylate, poly-n-laurylmethacrylate, and n-stearyl acrylate-ethyl methacrylate copolymers can also be used.

The above-described charge control agents and release agents can be dissolved and dispersed after kneaded upon application of heat together with a master batch pigment and a binder resin, and can be added when directly dissolved or dispersed in an organic solvent.

(External Additives)

The toner particles are preferably mixed with an external additive to assist in improving the fluidity, developing property and charging ability of the toner particles. Preferable external additives include inorganic fine particles. The inorganic fine particles preferably have a primary particle diameter of from $5\times10^{-3}$ to $5\times10^{2}$ μm, and more preferably from $5\times10^{-3}$ to $5\times10^{0.5}$ μm. In addition, the inorganic fine particles preferably has a specific surface area measured by a BET method of from 20 $m^2/g$ to 500 $m^2/g$. The content of the external additive is preferably from 0.01% to 5% by weight, and more preferably from 0.01% to 2.0% by weight, based on total weight of the toner composition. Specific examples of the inorganic fine particles include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among the above-described examples, a combination of a hydrophobic silica and a hydrophobic titanium oxide is preferably used. In particular, the hydrophobic silica and the hydrophobic titanium oxide each having an average particle diameter of not greater than $5\times10^{-4}$ μm considerably improves an electrostatic force between the toner particles and van der Waals force. Accordingly, the resultant toner composition has a proper charge quantity. In addition, even when the toner composition is agitated in the developing devices 5, the external additive is hardly released from the toner particles. As a result, image defects such as white spots and image omissions are hardly produced. Further, the amount of residual toner after transfer can be reduced. When titanium oxide fine particles are used as the external additive, the resultant toner can reliably form toner images having a proper image density even when environmental conditions are changed. However, the charge rising properties of the resultant toner tend to deteriorate. Therefore, an additive amount of the titanium oxide fine particles is preferably smaller than that of silica fine particles. The total additive amount of hydrophobic silica fine particles and hydrophobic titanium oxide fine particles is preferably from 0.3% to 1.5% by weight based on weight of the toner particles to reliably form higher-quality images without degrading charge rising properties even when images are repeatedly formed.

A method for manufacturing the toner is described in detail below, but is not limited thereto.

(Method for Manufacturing Toner)

(1) The colorant, the unmodified polyester, the polyester prepolymer having an isocyanate group, and the release agent are dispersed in an organic solvent to obtain toner constituent liquid.

From the viewpoint of easy removal after formation of parent toner particles, it is preferable that the organic solvent be volatile and have a boiling point of not greater than 100° C. Specific examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethylketone, and methylisobutylketone. The above-described materials can be used alone or in combination. In particular, aromatic solvent such as toluene and xylene, and chlorinated hydrocarbon such as methylene chloride, 1,2-dichloroethane, chloroform, and carbon tetrachloride are preferably used. The toner constituent liquid preferably includes the organic solvent in an amount of from 0 to 300 parts by weight, more preferably from 0 to 100 parts by weight, and even more preferably from 25 to 70 parts by weight based on 100 parts by weight of the prepolymer.

(2) The toner constituent liquid is emulsified in an aqueous medium under the presence of a surfactant and a particulate resin.

The aqueous medium may include water alone or a mixture of water and an organic solvent. Specific examples of the organic solvent include alcohols such as methanol, isopropanol, and ethylene glycol; dimethylformamide; tetrahydrofuran; cellosolves such as methyl cellosolve; and lower ketones such as acetone and methyl ethyl ketone.

The toner constituent liquid includes the aqueous medium in an amount of from 50 to 2,000 parts by weight, and preferably from 100 to 1,000 parts by weight based on 100 parts by weight of the toner constituent liquid. When the amount of the aqueous medium is too small, the toner constituent liquid is not well dispersed and toner particles having a predetermined particle diameter cannot be formed. By contrast, when the amount of the aqueous medium is too large, production costs increase.

A dispersant such as a surfactant or an organic particulate resin is optionally included in the aqueous medium to improve the dispersion therein.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives, and imidazoline) and quaternary ammonium salts (e.g., alkyltrimethyl ammonium salts, dialkyldimethyl ammonium salts, alkyldimethyl benzyl ammonium salts, pyridinium salts, alkyl isoquinolinium salts, and benzethoniurn chloride); nonionic surfactants such as fatty acid amide derivatives and polyhydric alcohol derivatives; and ampholytic surfactants such as alanine, dodecyldi(aminoethyl)glycin, di(octylaminoethyle)glycin, and N-alkyl-N,N-dimethylammonium betaine.

A surfactant having a fluoroalkyl group can achieve a dispersion having high dispersibility even when a smaller amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-[ω-fluoroalkyl(C6-C11)oxy]-1-alkyl(C3-C4)sulfonate, sodium-[ω-fluoroalkanoyl(C6-C8)-N-ethylamino]-1-propane sulfonate, fluoroalkyl(C11-C20) carboxylic acids and their metal salts, perfluoroalkylcarboxylic acids (C7-C13) and their metal salts, perfluoroalkyl(C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, and monoperfluoroalkyl(C6-C16) ethylphosphates.

Specific examples of commercially available surfactants include SURFLON® S-111, SURFLON® S-112, and SURFLON® S-113 manufactured by AGC Seimi Chemical Co., Ltd.; FRORARD FC-93, FC-95, FC-98, and FC-129 manufactured by Sumitomo 3M Ltd.; UNIDYNE DS-101 and DS-102 manufactured by Daikin Industries, Ltd.; MEGAFACE F-110, F-120, F-113, F-191, F-812, and F-833 manufactured by DIC Corporation; EFTOP EF-102, EF-103, EF-104, EF-105, EF-112, EF-123A, EF-123B, EF-306A, EF-501, EF-201, and EF-204 manufactured by JEMCO Inc.; and FUTARGENT F-100 and F-150 manufactured by Neos Co., Ltd.

Specific examples of cationic surfactants include primary and secondary aliphatic amines or secondary amino acid having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, and imidazolinium salts. Specific examples of commercially available products thereof include SURFLON® S-121 manufactured by AGC Seimi Chemical Co., Ltd.; FRORARD FC-135 manufactured by Sumitomo 3M Ltd.; UNIDYNE DS-202 manufactured by Daikin Industries, Ltd.; MEGAFACE F-150 and F-824 manufactured by DIC Corporation; EFTOP EF-132 manufactured by JEMCO Inc.; and FUTARGENT F-300 manufactured by Neos Co., Ltd.

The resin particles are added to stabilize parent toner particles formed in the aqueous medium. Therefore, the resin particles are preferably added so as to have a coverage of from 10% to 90% over a surface of the parent toner particles. Specific examples of the resin particles include polymethylmethacrylate particles having a particle diameter of 1 μm and 3 μm, polystyrene particles having a particle diameter of 0.5 μm and 2 μm, and poly(styrene-acrylonitrile) particles having a particle diameter of 1 μm. Specific examples of commercially available products thereof include PB-200H manufactured by Kao Corporation, SGP manufactured by Soken Chemical & Engineering Co., Ltd., Technopolymer SB manufactured by Sekisui Plastics Co., Ltd., SGP-3G manufactured by Soken Chemical & Engineering Co., Ltd., and Micropearl manufactured by Sekisui Chemical Co., Ltd. In addition, inorganic dispersants such as tricalcium phosphate, calcium carbonate, titanium oxide, colloidal silica, and hydroxy apatite can also be used.

As dispersants which can be used in combination with the above-described resin particles and inorganic dispersants, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid, and maleic anhydride), (meth)acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, and N-methylolmethacrylamide), vinyl alcohol and its ethers (e.g., vinyl methyl ether, vinyl ethyl ether, and vinyl propyl ether), esters of vinyl alcohol with a compound having a carboxyl group (e.g., vinyl acetate, vinyl propionate, and vinyl butyrate), acrylic amides (e.g., acrylamide, methacrylamide, and diacetoneacrylamide) and their methylol compounds, acid chlorides (e.g., acrylic acid chloride and methacrylic acid chloride), nitrogen-containing compounds (e.g., vinyl pyridine, vinyl pyrrolidone, vinyl imidazole, and ethylene imine), and homopolymer or copolymer having heterocycles of the nigtroge-containnig compounds. In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds (e.g., methyl cellulose, hydroxyethyl cellulose, and hydroxypropyl cellulose) can also be used as the polymeric protective colloid.

The dispersion method is not particularly limited, and well-known methods such as low speed shearing methods, high-speed shearing methods, friction methods, high-pressure jet methods, and ultrasonic methods can be used. Among the above-described methods, the high-speed shearing methods are preferably used because particles having a particle diameter of from 2 μm to 20 μm can be easily prepared. When a high-speed shearing type dispersion machine is used, the rotation speed is not particularly limited, but the rotation speed is typically from 1,000 rpm to 30,000 rpm, and preferably from 5,000 rpm to 20,000 rpm. The dispersion time is not particularly limited, but is typically from 0.1 to 5 minutes for a batch method. The temperature in the dispersion process is typically from 0° C. to 150° C. (under pressure), and preferably from 40° C. to 98° C.

(3) While the emulsion is prepared, amines (B) are added thereto to react with the polyester prepolymer (A) having an isocyanate group.

This reaction is accompanied by cross-linking and/or elongation of a molecular chain. The reaction time depends on reactivity of an isocyanate structure of the polyester prepolymer (A) and amines (B), but is typically from 10 minutes to 40 hours, and preferably from 2 to 24 hours. The reaction temperature is typically from 0° C. to 150° C., and preferably from 40° C. to 98° C. In addition, a known catalyst such as dibutyltinlaurate and dioctyltinlaurate can be used as needed.

(4) After completion of the reaction, the organic solvent is removed from the emulsified dispersion (a reactant), and subsequently, the resulting material is washed and dried to obtain a parent toner particle.

The prepared emulsified dispersion is gradually heated while stirred in a laminar flow, and an organic solvent is removed from the dispersion after stirred strongly when the dispersion has a specific temperature to form a parent toner particle having the shape of a spindle. When an acid such as calcium phosphate or a material soluble in alkaline is used as a dispersant, the calcium phosphate is dissolved with an acid such as a hydrochloric acid, and washed with water to remove the calcium phosphate from the parent toner particle. Besides the above-described method, the organic solvent can also be removed by an enzymatic hydrolysis.

(5) A charge control agent is provided to the parent toner particle, and inorganic fine particles such as silica fine particles and titanium oxide fine particles are added thereto to obtain toner. Well-known methods using a mixer or the like are used to provide the charge control agent and to add the inorganic fine particles.

Accordingly, toner having a smaller particle diameter and a sharper particle diameter distribution can be easily obtained. Further, the strong agitation in the process of removing the organic solvent can control the toner to have a shape between a spherical shape and a spindle shape, and a surface morphology between a smooth surface and a rough surface.

Figure 11A:
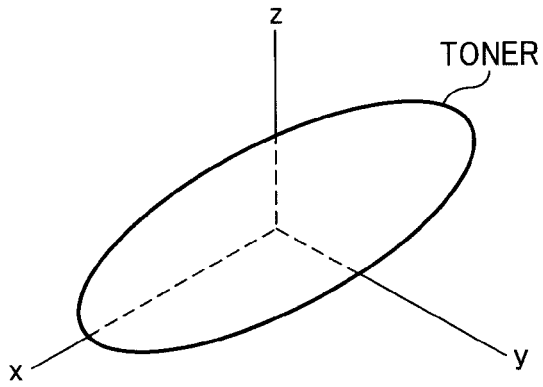
FIGS. 11A, 11B, and 11C are schematic views illustrating a shape of a toner particle, respectively.
Figure 11B:
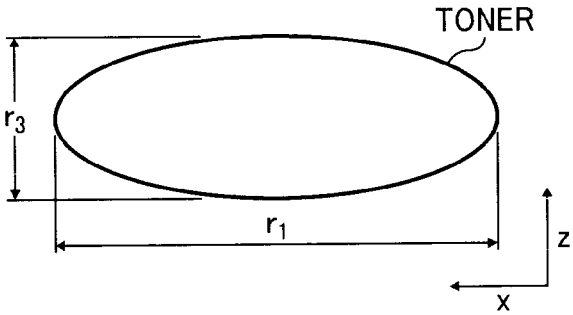
Figure 11C:
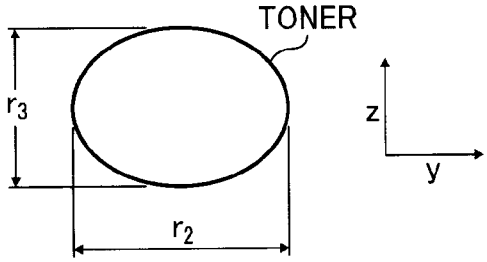

The toner used in the image forming apparatus 50 according to illustrative embodiments has a substantially spherical shape that can be defined as follows. FIGS. 11A to 11C are schematic views respectively illustrating a shape of the toner. The toner has a substantially spherical shape with a long axis r1, a short axis r2, and a thickness r3 that satisfy a relationship of r≥r2≥r3. It is preferable that a ratio (r2/r1) of the short axis r2 to the long axis 1/ be in a range between 0.5 and 1.0, and a ratio (r3/r2) of the thickness r3 to the short axis r2 be in a range between 0.7 and 1.0. When the ratio (r2/r1) of the short axis r2 to the long axis r1 is less than 0.5, a shape of the toner is not spherical, and both dot-reproductivity and transfer efficiency are decreased. When the ratio (r3/r2) of the thickness r3 to the short axis r2 is less than 0.7, a shape of the toner is flattened. Consequently, a high transfer ratio as obtained when the toner is spherical cannot be achieved. In particular, when the ratio (r3/r2) of the thickness r3 to the short axis r2 is 1.0, the toner is rotated around the long axis r1 as a rotary shaft, thereby improving flowability of the toner.

It is to be noted that each of r1, r2, r3 was measured by taking pictures of the toner by a scanning electron microscope (SEM) at different viewing angles.

Figure 12:
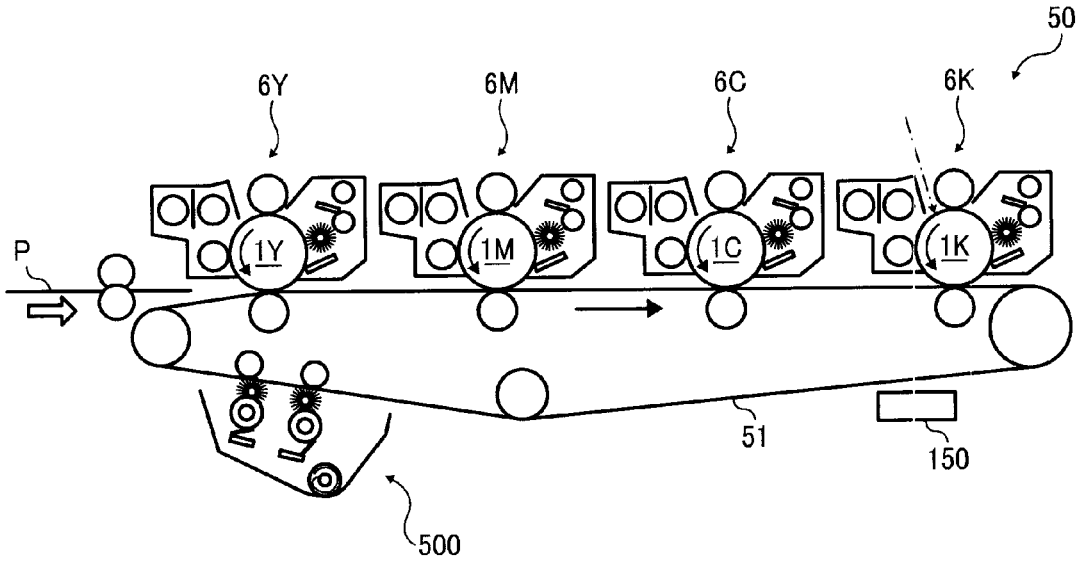
FIG. 12 is a vertical cross-sectional view illustrating an example of configuration of a main part of an image forming apparatus employing a tandem-type direct transfer system.

The belt cleaning device 100 according to the foregoing illustrative embodiments is also applicable to a conveyance belt cleaning device 500 that cleans a conveyance belt 51 illustrated in FIG. 12. FIG. 12 is a schematic view illustrating a configuration of the image forming apparatus 50 employing a tandem-type direct transfer system. As illustrated in FIG. 12, the conveyance belt 51 included in the image forming apparatus 50 employing the tandem-type direct transfer system contacts each of the photoconductors 1 to form transfer nips therebetween. The conveyance belt 51 is rotated in a clockwise direction in FIG. 12 while bearing the sheet P to sequentially convey the sheet P to each of the transfer nips. As a result, the toner images of the respective colors are directly transferred onto the sheet P from the surfaces of the photoconductors 1, and are sequentially superimposed one atop the other on the sheet P to form a full-color toner image on the sheet P. Foreign substances or toner attached to the conveyance belt 51 after passing through the transfer nip between the conveyance belt 51 and the photoconductor 1K are removed by the conveyance belt cleaning device 500. The optical sensor unit 150 is provided opposite the conveyance belt 51 with a predetermined interval therebetween. In the image forming apparatus 50 illustrated in FIG. 12, image density is controlled and an amount of positional shift is corrected at a predetermined timing to form the toner pattern such as the graduation patterns S and the chevron patch on the conveyance belt 51. The toner pattern thus formed is detected by the optical sensor unit 150 to perform predetermined correction or control based on the result thus detected. The toner pattern thus detected by the optical sensor unit 150 is removed from the conveyance belt 51 by the conveyance belt cleaning device 500. Thus, the conveyance belt 51 functions as an image carrier that carries the toner image.

The belt cleaning device 100 employed as the conveyance belt cleaning device 500 described above can reliably remove the toner pattern formed on the conveyance belt 51, thereby preventing a back surface of the sheet P from being stained with toner or the like.

Figure 13:
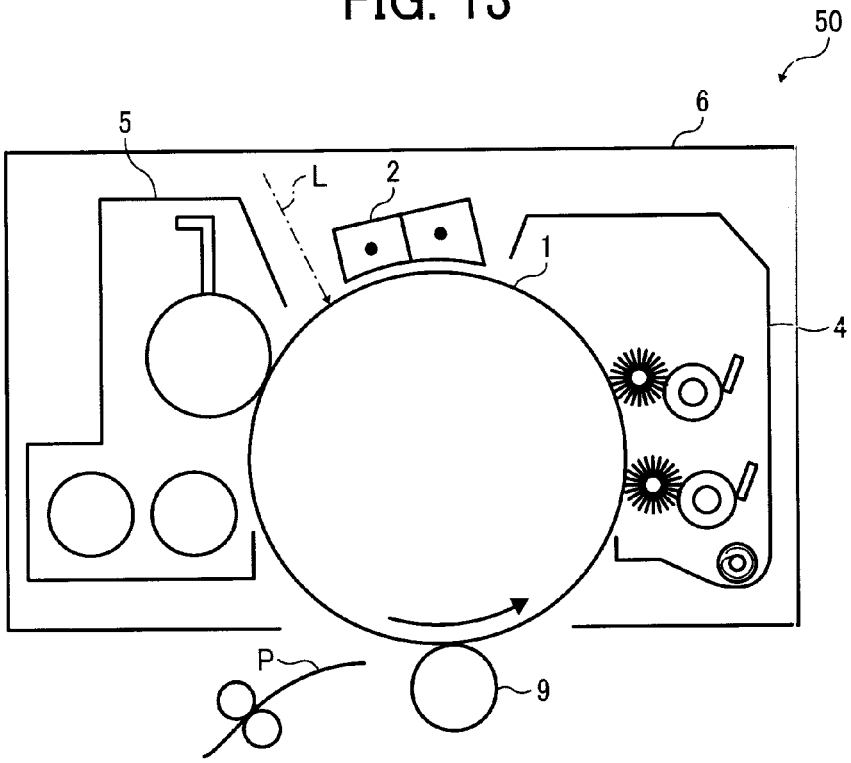
FIG. 13 is a schematic view illustrating another example of a configuration of a process unit included in the image forming apparatus.

In addition, the belt cleaning device 100 is also applicable to the drum cleaning device 4 as illustrated in FIG. 13. FIG. 13 is a schematic view illustrating another example of a configuration of the process unit 6. An optical sensor unit, not shown, is provided opposite the photoconductor 1 with a certain interval therebetween to detect a graduation pattern formed on the photoconductor 1. The graduation pattern thus detected by the optical sensor unit is then conveyed to the drum cleaning device 4. Thus, the drum cleaning device 4 employing the belt cleaning device 100 can reliably remove the toner pattern from the photoconductor 1.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A cleaning device comprising:

a rotatable cleaning member contacting a rotatable image carrier bearing a toner image to electrostatically remove toner from the image carrier while rotating; and a control unit to control rotation of the cleaning member to satisfy a relation of (60/R)>(L/V) during removal of a toner pattern formed on the image carrier at a predetermined timing and remaining attached to the image carrier without being transferred from the image carrier onto a transfer member using the cleaning member, where R (rpm) is a number of rotations of the cleaning member, L (mm) is a length of the toner pattern in a direction of rotation of the image carrier, and V (mm/s) is a speed of the image carrier.

2. A cleaning device comprising:

multiple cleaning members arranged consecutively in a direction of rotation of an image carrier and contacting the image carrier bearing a toner image to electrostatically remove toner from the image carrier while rotating; and a control unit to control rotation of a cleaning member among the multiple cleaning members provided on an extreme upstream side in the direction of rotation of the image carrier to satisfy a relation of (60/R)>(L/V) during removal of a toner pattern formed on the image carrier at a predetermined timing and remaining attached to the image carrier without being transferred from the image carrier onto a transfer member using the multiple cleaning members, where R (rpm) is a number of rotations of the cleaning member provided on the extreme upstream side in the direction of rotation of the image carrier, L (mm) is a length of the toner pattern in the direction of rotation of the image carrier, and V (mm/s) is a speed of the image carrier.

3. An image forming apparatus comprising:

a rotatable image carrier;

an image forming unit to form a toner image on the image carrier;

a cleaning device comprising a rotatable cleaning member to electrostatically remove toner from the image carrier while rotating; and a control unit to control at least one of the image forming unit, a speed of the image carrier, and rotation of the cleaning member to satisfy a relation of (60/R)>(L/V) during removal of a toner pattern formed on the image carrier at a predetermined timing and remaining attached to the image carrier without being transferred from the image carrier onto a transfer member using the cleaning member, where R (rpm) is a number of rotations of the cleaning member, L (mm) is a length of the toner pattern in a direction of rotation of the image carrier, and V (mm/s) is a speed of the image carrier.

4. The image forming apparatus according to claim 3, wherein the control unit controls at least one of the image forming unit, the speed of the image carrier, and the number of rotations of the cleaning member to satisfy a relation of (60/R)<(C/V), where C (mm) is an interval between successive toner patterns.

5. The image forming apparatus according to claim 3, wherein:

the cleaning device comprises multiple cleaning members;

a bias having a polarity opposite a normal charging polarity of toner is supplied to a cleaning member among the multiple cleaning members provided on an upstream side in the direction of rotation of the image carrier to electrostatically remove normally charged toner from the image carrier; and R represents the number of rotations of the cleaning member provided on the extreme upstream side in the direction of rotation of the image carrier.

* * * * *